US011033082B1

(12) United States Patent
Riot et al.

(10) Patent No.: US 11,033,082 B1
(45) Date of Patent: Jun. 15, 2021

(54) WEARABLE DEVICE STRAPS AND ATTACHMENT HARDWARE THEREFOR

(71) Applicant: Fitbit, Inc., San Francisco, CA (US)

(72) Inventors: Benjamin Patrick Robert Jean Riot, San Francisco, CA (US); Henry Michael Lubowe, San Francisco, CA (US); Edison Tam King Miguel, Newark, CA (US); Matthew Joseph Kane, Berkeley, CA (US); Jens Mitchell Nielsen, San Francisco, CA (US); Cédric Eric Jean-Edouard Bernard, San Francisco, CA (US); Chadwick John Harber, San Francisco, CA (US); Brian Dennis Paschke, San Francisco, CA (US); Stephanie Lydia Renee Choplin, San Francisco, CA (US); Mark Woolhiser Huang, San Francisco, CA (US); Lindsey Michelle Sunden, San Francisco, CA (US); Keith Adam Wong, San Francisco, CA (US); Hamed Vavadi, Fremont, CA (US)

(73) Assignee: Fitbit, Inc., San Francisco, CA (US)

( * ) Notice: Subject to any disclaimer, the term of this patent is extended or adjusted under 35 U.S.C. 154(b) by 0 days.

(21) Appl. No.: 16/848,322

(22) Filed: Apr. 14, 2020

(51) Int. Cl.
*A44C 5/14* (2006.01)
*A44C 5/00* (2006.01)

(52) U.S. Cl.
CPC ..... *A44C 5/147* (2013.01); *A44C 5/0053* (2013.01)

(58) Field of Classification Search
CPC ..... A44C 5/147; A44C 5/18; A44C 5/185; A44C 5/2028; A44C 5/2033; A44C 5/2042; A44C 5/2047; A44C 5/2052
See application file for complete search history.

(56) References Cited

U.S. PATENT DOCUMENTS

| | | | | |
|---|---|---|---|---|
| 2,443,805 | A * | 6/1948 | Segal | A44B 11/24 24/188 |
| 3,165,884 | A | 1/1965 | Gwinner et al. | |
| 4,217,681 | A | 8/1980 | Grohoski et al. | |
| 4,231,502 | A | 11/1980 | Meyerson | |
| 6,935,771 | B2 | 8/2005 | Engel | |
| 8,727,189 | B2 | 5/2014 | Zieman et al. | |
| 9,014,790 | B2 | 4/2015 | Richards et al. | |
| 9,042,971 | B2 | 5/2015 | Brumback et al. | |
| 9,168,419 | B2 | 10/2015 | Hong et al. | |

(Continued)

FOREIGN PATENT DOCUMENTS

CN 207754685 8/2018

OTHER PUBLICATIONS

U.S. Notice of Allowance dated Sep. 10, 2020, in U.S. Appl. No. 15/985,853.

(Continued)

*Primary Examiner* — Derek J Battisti
(74) *Attorney, Agent, or Firm* — Dority & Manning P.A.

(57) ABSTRACT

Low-profile latching mechanisms and related mechanical interfaces for allowing straps and other fastening accessories for limb-wearable devices are provided. The mechanisms in question allow for a very strong, yet easily releasable, connection to be made between a strap accessory and a device housing, with very little of the mechanism being visible.

22 Claims, 17 Drawing Sheets

(56) References Cited

U.S. PATENT DOCUMENTS

| | | | | |
|---|---|---|---|---|
| 9,307,917 | B2 | 4/2016 | Hong et al. | |
| 9,402,552 | B2 | 8/2016 | Richards et al. | |
| 9,543,636 | B2 | 1/2017 | Baringer et al. | |
| 9,572,533 | B2 | 2/2017 | Venkatraman et al. | |
| 9,599,632 | B2 | 3/2017 | Yuen | |
| 9,603,524 | B2 | 3/2017 | Park et al. | |
| 9,641,239 | B2 | 5/2017 | Panther et al. | |
| 10,004,406 | B2 | 6/2018 | Yuen et al. | |
| 10,058,149 | B1 * | 8/2018 | Wittenberg | H01R 11/30 |
| 10,136,543 | B1 | 11/2018 | Nadkarni et al. | |
| 10,178,894 | B2 | 1/2019 | Vandenbussche | |
| 10,219,591 | B2 * | 3/2019 | Hatanaka | A44C 5/14 |
| 10,327,520 | B1 * | 6/2019 | Ely | A44C 5/14 |
| 10,418,693 | B2 | 9/2019 | Xu et al. | |
| 10,646,007 | B2 | 5/2020 | McCray et al. | |
| 10,797,383 | B2 | 10/2020 | Xu et al. | |
| 10,809,666 | B2 | 10/2020 | Markan et al. | |
| 2005/0265132 | A1 * | 12/2005 | Ho | G04B 37/1486 368/282 |
| 2006/0044201 | A1 | 3/2006 | Arnold et al. | |
| 2007/0064542 | A1 | 3/2007 | Fukushima | |
| 2015/0212541 | A1 | 7/2015 | Lu et al. | |
| 2015/0255871 | A1 | 9/2015 | Baringer | |
| 2015/0364813 | A1 | 12/2015 | Darnell et al. | |
| 2016/0037877 | A1 * | 2/2016 | Perkins | H05K 999/99 224/164 |
| 2016/0037897 | A1 * | 2/2016 | Bataillou | A44C 5/20 224/267 |
| 2016/0056533 | A1 | 2/2016 | Nissinen et al. | |
| 2016/0064280 | A1 | 3/2016 | Ookita et al. | |
| 2017/0181510 | A1 * | 6/2017 | Novak | A44C 5/185 |
| 2017/0187096 | A1 | 6/2017 | Hwang et al. | |
| 2018/0011448 | A1 * | 1/2018 | Von Allmen | G04B 37/16 |
| 2018/0090890 | A1 | 3/2018 | Kallman et al. | |
| 2018/0289115 | A1 | 10/2018 | McCray et al. | |
| 2018/0289116 | A1 | 10/2018 | McCray et al. | |
| 2018/0294554 | A1 * | 10/2018 | Xu | G04G 17/04 |
| 2019/0174882 | A1 | 6/2019 | Cuenat et al. | |
| 2019/0361402 | A1 | 11/2019 | Markan et al. | |
| 2020/0014098 | A1 | 1/2020 | Xu et al. | |
| 2020/0154835 | A1 * | 5/2020 | Chen | G04B 37/1486 |

OTHER PUBLICATIONS

U.S. Notice of Allowance dated Jan. 15, 2020, in U.S. Appl. No. 15/627,915.

U.S. Office Action dated Jan. 2, 2019, in U.S. Appl. No. 15/820,928.

U.S. Notice of Allowance dated May 8, 2019, in U.S. Appl. No. 15/820,928.

U.S. Office Action dated Feb. 20, 2020, in U.S. Appl. No. 16/571,482.

U.S. Notice of Allowance dated Jun. 12, 2020, in U.S. Appl. No. 16/571,482.

U.S. Office Action dated Mar. 24, 2020, in U.S. Appl. No. 15/985,853.

Chinese Office Action dated Apr. 10, 2018, for Chinese Patent Application No. 201721357976.X, filed Oct. 20, 2017.

"40mm Black Sport Band—Regular," Apple. 3 pgs. Downloaded Jul. 10, 2020. <https://www.apple.com/shop/product/MTP62AM/A/40mm-black-sport-band-regular?afid=p238%7CsxTBcV4Rt-dc_mtid_1870765e38482_pcrid_349060169746_pgrid_68474163257_&cid=aos-us-kwgo-pla---slid---product-MTP62AM/A>.

"Galazy Fit, Silver," Samsung. 22 pgs. Downloaded Jul. 10, 2020. <https://www.samsung.com/us/mobile/wearables/smart-fitness-bands/samsung-galaxy-fit-sm-r370nzsaxar/>.

"Lumina Handlebar Clamp Mount," NiteRider Technical Lighting, 7 pgs. Downloaded May 17, 2018. <https://www.niterider.com/product/lumina-handlebar-clamp-mount/>.

"Lumina Helmet Mount," NiteRider Technical Lighting, 7 pgs. Downloaded May 17, 2018. <https://www.niterider.com/product/lumina-helmet-mount/>.

"GoPro Adapter by K-Edge," NiteRider Technical Lighting, 8 pgs. Downloaded May 17, 2018. <https://www.niterider.com/product/gopro-adapter/>.

U.S. Appl. No. 16/855,976, filed Apr. 22, 2020, Riot et al.

* cited by examiner

Figure 35
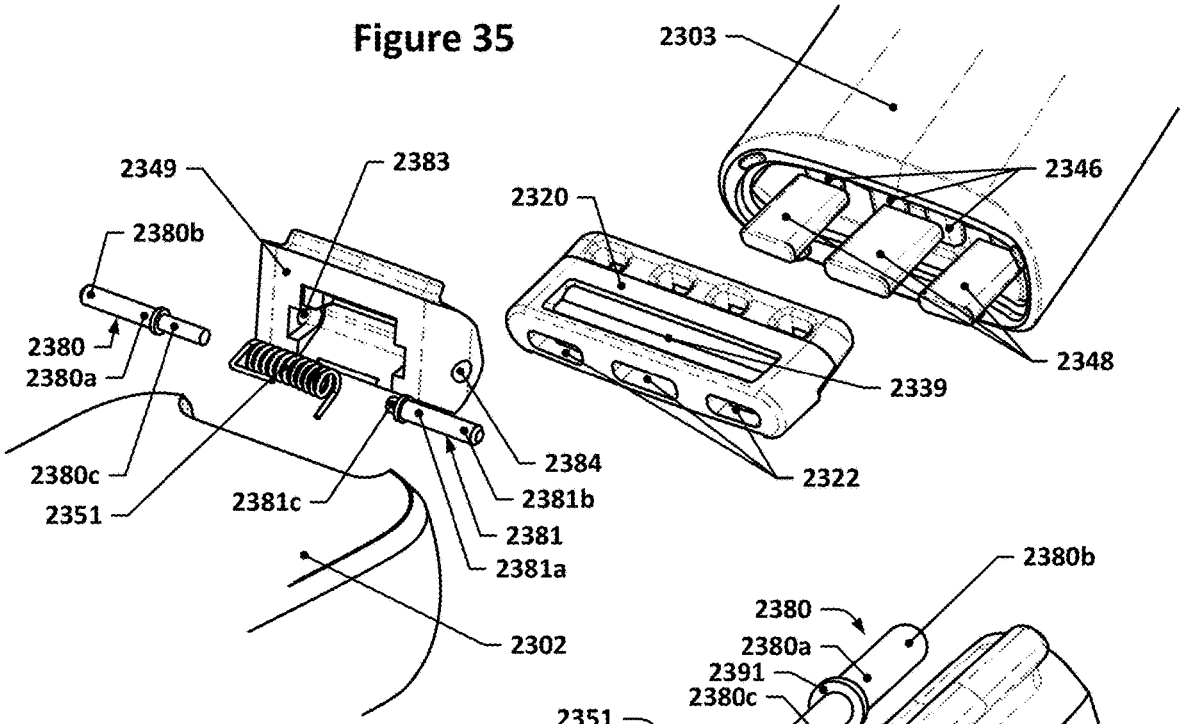
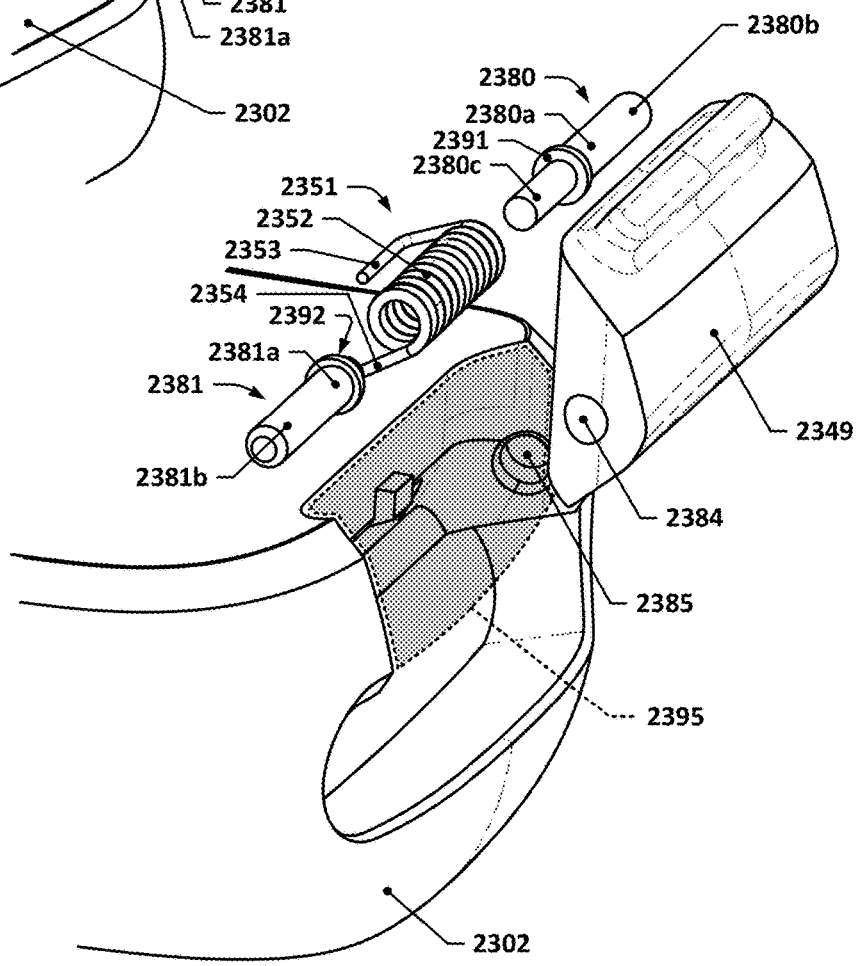
Figure 36

WEARABLE DEVICE STRAPS AND ATTACHMENT HARDWARE THEREFOR

BACKGROUND

Wearable devices, such as watches or personal fitness and health monitoring devices, which may be referred to as biometric monitoring devices or fitness trackers herein, may be worn on a limb of a user, e.g., on the user's arm. To facilitate such use, such wearable devices may feature a housing that has a strap extending from opposing sides thereof, with the straps including some sort of clasp or fastening system that allows the free ends thereof to be fastened together so that the wearable device may be secured to the user's limb and worn in a particular orientation. Some wearable devices may include easily removable straps that may be replaced with other straps for a different look or feel, or to provide different functionality.

Disclosed herein are new mechanisms that may be used to provide removable strap functionality in a wearable device, as well as variations on straps that may be used with wearable devices (with or without such mechanisms).

SUMMARY

Details of one or more implementations of the subject matter described in this specification are set forth in the accompanying drawings and the description below. Other features, aspects, and advantages will become apparent from the description, the drawings, and the claims.

In some implementations, an apparatus may be provided that includes a rigid insert. The rigid insert may include an insertion portion that may be configured to be insertable into a latching receptacle of a limb-wearable device, and the insertion portion of the rigid insert may have an outermost cross-sectional boundary, that is, when viewed along a first axis, inscribed within a boundary region defined between a first semicircle, a second semicircle, a first segment spanning between a first end of the first semicircle and a first end of the second semicircle, and a second segment spanning between a second end of the second semicircle and a second end of the first semicircle. The insertion portion may also have a first surface that may be perpendicular to the first axis and a second surface and a third surface that may both be generally perpendicular to the first surface, with the first surface interposed between the second surface and the third surface when viewed along the first axis. A recess may be located in the second surface and may be defined, at least in part, by a latching surface that extends from the second surface towards the third surface and that may be positioned such that it interfaces with a latch mechanism in the latching receptacle of the limb-wearable device when the rigid insert is fully inserted into the latching receptacle of the limb-wearable device. The latching surface may have a width along a direction nominally parallel to the second surface that may be at least 8 mm, and the latching surface may form a first included angle with the first surface of between 20° and 50°.

In some implementations, the insertion portion may not include any components that are movable relative to the remainder of the insertion portion.

In some implementations, the second surface, the third surface, or both the second surface and the third surface may be tapered by between 0.01° and 1° from the first axis.

In some implementations, the second surface, the third surface, or both the second surface and the third surface may be tapered by between 0.4° and 0.6° from the first axis.

In some implementations, the latching surface and the second surface may virtually intersect at a location that may be offset from the first surface in a direction normal to the first surface by a distance of between 0.35 mm and 0.6 mm.

In some implementations, the recess may be further defined by a floor surface, and the floor surface may span between a first end proximate to the latching surface and a second end proximate to the second surface and may also form a second included angle with the second surface that may be between 7° and 10°.

In some implementations, the second surface may be a concave surface and the third surface may be a convex surface.

In some implementations, the insertion portion may have an exterior surface with an arcuate obround profile, the second surface and the third surface may be spaced apart by a gap, a first endcap surface may span between, and may be tangent to, first ends of the second surface and the third surface, and a second endcap surface may span between, and may be tangent to, second ends of the second surface and the third surface.

In some implementations, the latching surface and the second surface may virtually intersect at a location that may be offset from the first surface in a direction normal to the first surface by a distance of between 0.35 mm and 0.45 mm.

In some implementations, the second surface may be a planar surface and the third surface may be a convex surface.

In some implementations, the insertion portion may have an exterior surface with a hybrid obround profile, the second surface and the third surface may be spaced apart by a gap, a first endcap surface may span between, and may be tangent to, first ends of the second surface and the third surface, and a second endcap surface may span between, and may be tangent to, second ends of the second surface and the third surface.

In some implementations of the apparatus, the rigid insert may further include a plurality of first holes and a plurality of second holes, the first holes may extend through the rigid insert along axes spanning between the second surface and the third surface, and the second holes may extend through the rigid insert in first directions generally aligned with the first axis.

In some such implementations of the apparatus, the apparatus may further include a co-molded elastomeric strap that may include first bridging portions that extend through the first holes. In such implementations, each first bridging portion may have a first end and a second end that may each be connected with the first end or the second end of one or more of the other first bridging portions by a continuous portion of the co-molded elastomeric strap other than that first bridging portion.

In some further such implementations, the co-molded elastomeric strap may include second bridging portions that extend through the second holes. In such implementations, each second bridging portion may have a first end and a second end that may each be connected with the first end or the second end of one or more of the other second bridging portions by a continuous portion of the co-molded elastomeric strap other than that second bridging portion.

In some implementations of the apparatus having a co-molded elastomeric strap, the co-molded elastomeric strap may include bumper posts that extend through the second holes, and each bumper post may have a first end that may be connected with the first end of one or more of the other bumper posts by a continuous portion of the co-molded elastomeric strap and a second end that may be proud of the first surface.

In some implementations of the apparatus having a co-molded elastomeric strap, the co-molded elastomeric strap may be configured to interface with a complementary adjustment strap, the co-molded elastomeric strap may have a main portion, a first pass-through portion, a peg portion, and a second pass-through portion, the peg portion may be interposed between the first pass-through portion and the second pass-through portion, the first pass-through portion may be interposed between the peg portion and the second pass-through portion, and the first pass-through portion and the second pass-through portion may each have a hole therethrough that may be sized to allow the complementary adjustment strap to pass therethrough.

In some such implementations, the main portion, the first pass-through portion, the second pass-through portion, and the peg portion may be arranged along a strap axis, and each of the holes in the first pass-through portion and the second pass-through portion may be an elongate hole with a long axis that is perpendicular to the strap axis and a length along the long axis that is greater than a width of at least a part of the main portion along an axis parallel to the long axis.

In some implementations of the apparatus having a co-molded elastomeric strap, the co-molded elastomeric strap may be made of one or more materials such as a hypoallergenic silicone, a silicone, or a thermoplastic elastomer.

In some implementations of the apparatus having a co-molded elastomeric strap, the rigid insert may include two or more bumper ports in an exterior surface of the rigid insert, and the co-molded elastomeric strap may include two or more bumpers that each extend through a corresponding one of the bumper ports and may be proud of the exterior surface.

In some implementations, the rigid insert may include a wall that extends away from the first surface and towards the latching surface, and the wall may follow the outermost cross-sectional boundary.

In some implementations, the rigid insert may include a protrusion portion that may extend away from the insertion portion in a direction oriented away from the first surface, the protrusion portion may include a second recess that extends from a midplane of the rigid insert to spaced-apart locations on either side of the midplane, the midplane may be generally parallel to the first surface and the second surface and centered on the rigid insert, the second recess may have end surfaces that face each other and may be generally perpendicular to the first surface and the second surface, and each end surface may have a hole therein.

In some implementations, the rigid insert may include a protrusion portion that extends away from the insertion portion in a direction oriented away from the first surface, the protrusion portion may include a second recess that extends from a midplane of the rigid insert to spaced-apart locations on either side of the midplane, the midplane may be generally parallel to the first surface and the second surface and centered on the rigid insert, and the protrusion portion may include a first portion that may have a first width in a first direction parallel to the first surface and the second surface and a second portion that may have a second width in the first direction. In such implementations, the first portion may be between the second portion and the insertion portion, the first width may be larger than the second width, the second portion may have opposing end surfaces that may be generally perpendicular to the first direction and that may face in opposite directions, the recess may have end surfaces that face each other, may be generally perpendicular to the first surface and the second surface, and may be spaced apart on either side of the midplane, and the second portion may have a hole therethrough that may extend between the end surfaces.

In some implementations, the apparatus may further include a strap having a first end with a plurality of retention holes therethrough. In such implementations, the rigid insert may include a top cap and a bottom cap, a series of post-and-hole features may join the top cap to the bottom cap, and each post-and-hole feature may include a post protruding from either the top cap or the bottom cap (and towards the other of the top cap and the bottom cap) and a hole in the other of the top cap and the bottom cap that is sized to receive that post. The top cap and the bottom cap may form an opening in an exterior surface of the rigid insert that is on an opposite side of the rigid insert from the first surface, and the first end of the strap may be inserted through the opening and each post-and-hole feature of one or more of the post-and-hole features may be inserted through a corresponding one of the retention holes.

In some implementations, an apparatus may be provided that includes a device housing having a latching receptacle, a release button, one or more axles, and a first spring. The latching receptacle may have an opening defined by a plurality of surfaces including a top surface, a first side surface, and a second side surface, and the opening may have a floor surface that may be adjacent to the top surface, the first side surface, and the second side surface. Additionally, the release button may include an engagement surface and a flank surface, the opening may be further defined by the flank surface, the engagement surface may face towards the floor surface, the release button may be supported by the one or more axles relative to the device housing and may be configured to pivot about a pivot axis of the one or more axles relative to the device housing, and the first spring may be configured to apply a biasing force to the release button to cause a portion of the release button that is closest to the floor surface to be rotatably urged towards the top surface.

In some implementations, the one or more axles may include a first axle and a second axle that may be coaxial, a first portion of the first axle may be positioned in a first hole that may extend into the release button along the pivot axis and a second portion of the first axle may be positioned in a first pivot hole that extends into the device housing, a first portion of the second axle may be positioned in a second hole that may extend into the release button along the pivot axis and a second portion of the second axle may be positioned in a second pivot hole that extends into the device housing, and the first spring may be a helical torsion spring having a coil portion, a first leg extending from the coil portion, and a second leg extending from the coil portion. In such implementations, the first axle may extend at least partially into the coil portion, and the first spring may be torsionally compressed such that first leg is pressed against a portion of the release button and the second leg is pressed against a portion of the device housing.

In some such implementations, the apparatus may further include a second spring that may be a helical compression spring. The second spring may be configured to urge at least one axle of the first axle and the second axle to move along the pivot axis and in a direction away from a midpoint of the release button.

In some further such implementations, the first axle may include a first segment and a second segment, the first segment may have a first diameter, the second segment may have a second diameter, the second diameter may be smaller than the first diameter, and the second segment may extend into the coil portion.

In some implementations, the first spring may be an open-wound helical torsion spring that may be interposed between the first axle and the second axle and configured to urge the first axle and the second axle to move away from each other along the pivot axis.

In some such implementations, the first axle may have a first radial shoulder surface and a third portion that may extend therefrom and may be inserted into the coil portion, the first radial shoulder surface may be interposed between the third portion of the first axle and the first portion of the first axle, the first radial shoulder surface may butt up against one end of the first spring, the second axle may have a second radial shoulder surface and a third portion that may extend therefrom and may be inserted into the coil portion, the second radial shoulder surface may be interposed between the third portion of the second axle and the first portion of the second axle, and the second radial shoulder surface may butt up against another end of the first spring.

In some implementations, the release button may be configured to be rotatable about the pivot axis between at least a first position and a second position, the flank surface, when the release button is in the first position, may be generally parallel to the top surface, and the flank surface may rotate through an angle of between 15° and 30° when the release button is rotated between the first position and the second position.

In some implementations of the apparatus, the device housing may have a bottom surface that extends up to a recess in the device housing in which the release button is located, the release button may have an exterior surface that may be nominally flush with the bottom surface, and the release button may include a protrusion that extends away from the exterior surface and in a direction away from the one or more axles.

In some such implementations, a surface of the protrusion facing away from the flank surface may have a concave profile when viewed along the pivot axis.

In some alternative or additional such implementations, the protrusion may protrude from the exterior surface by between 0.5 mm and 1 mm.

In some implementations having a protrusion, the surface of the protrusion that is furthest from the pivot axis may be between 1.5 mm and 3 mm from the pivot axis.

In some implementations of the apparatus, the first side surface and the second side surface may both be concave surfaces, the top surface may have a first end that meets the first side surface and a second end, opposite the first end, which meets the second side surface, and the top surface may be tangent to the first side surface and the second side surface where it meets the first side surface and the second side surface.

In some implementations of the apparatus, the first side surface, the second side surface, and the top surface may all be generally perpendicular to the floor surface.

In some implementations of the apparatus, the first side surface, the second side surface, the top surface, or combinations thereof may be tapered relative to an axis that is perpendicular to the floor surface by between 0.2° and 0.8°.

In some implementations of the apparatus, the shortest distance between the engagement surface and the pivot axis may be between 1.5 mm and 2 mm.

In some implementations of the apparatus, the flank surface and the engagement surface may form an included angle within the release button of between 100° and 145°.

In some implementations of the apparatus, the engagement surface may have a width along the pivot axis of between 7 mm and 11 mm.

In some implementations of the apparatus, the device housing may have a second latching receptacle with a second release button, a second spring, and one or more second axles, and the second latching receptacle may be on an opposite side of the device housing from the latching receptacle.

These and other implementations are discussed in more depth below and with respect to the Figures; the above listed implementations are not to be considered limiting, and additional implementations consistent with this disclosure are also considered to be within the scope of this disclosure.

BRIEF DESCRIPTION OF THE DRAWINGS

The various implementations disclosed herein are illustrated by way of example, and not by way of limitation, in the figures of the accompanying drawings, in which like reference numerals refer to similar elements.

FIG. 35 is a perspective exploded view of another example latching mechanism.

FIG. 36 is another perspective exploded view of the example latching mechanism of FIG. 35.

The Figures provided herein, except for FIGS. 12 through 15, are drawn to scale within each Figure, although the scale of the Figures from Figure to Figure may vary, as will be evident.

DETAILED DESCRIPTION

Importantly, the concepts discussed herein are not limited to any single aspect or implementation discussed herein, nor to any combinations and/or permutations of such aspects and/or implementations. Moreover, each of the aspects of the present invention, and/or implementations thereof, may be employed alone or in combination with one or more of the other aspects and/or implementations thereof. For the sake of brevity, many of those permutations and combinations will not be discussed and/or illustrated separately herein.

The various latch mechanisms and rigid inserts that interface therewith that are disclosed herein provide a system that allows for elastomeric, metal link, leather, or textile straps to be easily attached and removed from device housings for wearable devices, such as watches, fitness trackers, or other limb-wearable apparatuses. These systems provide for rapid, reliable attachment of such strap accessories to such device housings, but also, once connected with such a strap accessory, provide an extremely resilient connection that maintains its integrity even when the strap accessory is subjected to a significant pull-out force, e.g., such as may be experienced when the wearer snags the strap accessory on an obstacle while rapidly moving their arm.

Such latch systems are designed such that the latching mechanism itself is integrated into a latching receptacle that is part of the device housing, while the strap accessories incorporate a rigid insert that, itself, has no moving parts that interact with the latching receptacle or the latching mechanism. This provides several benefits, including allowing for simpler construction of the strap accessories (and thereby reducing the manufacturing cost of the strap accessories), allowing the strap accessories to have streamlined and low-profile ends that are insertable into the latching receptacle, and allowing for a stronger latching connection than is possible with a strap-based latching mechanism in the same or similar form-factor.

While two examples of such latching systems are discussed herein, it will be apparent that this disclosure extends to other variants that are consistent with the examples discussed herein.

Figure 1:
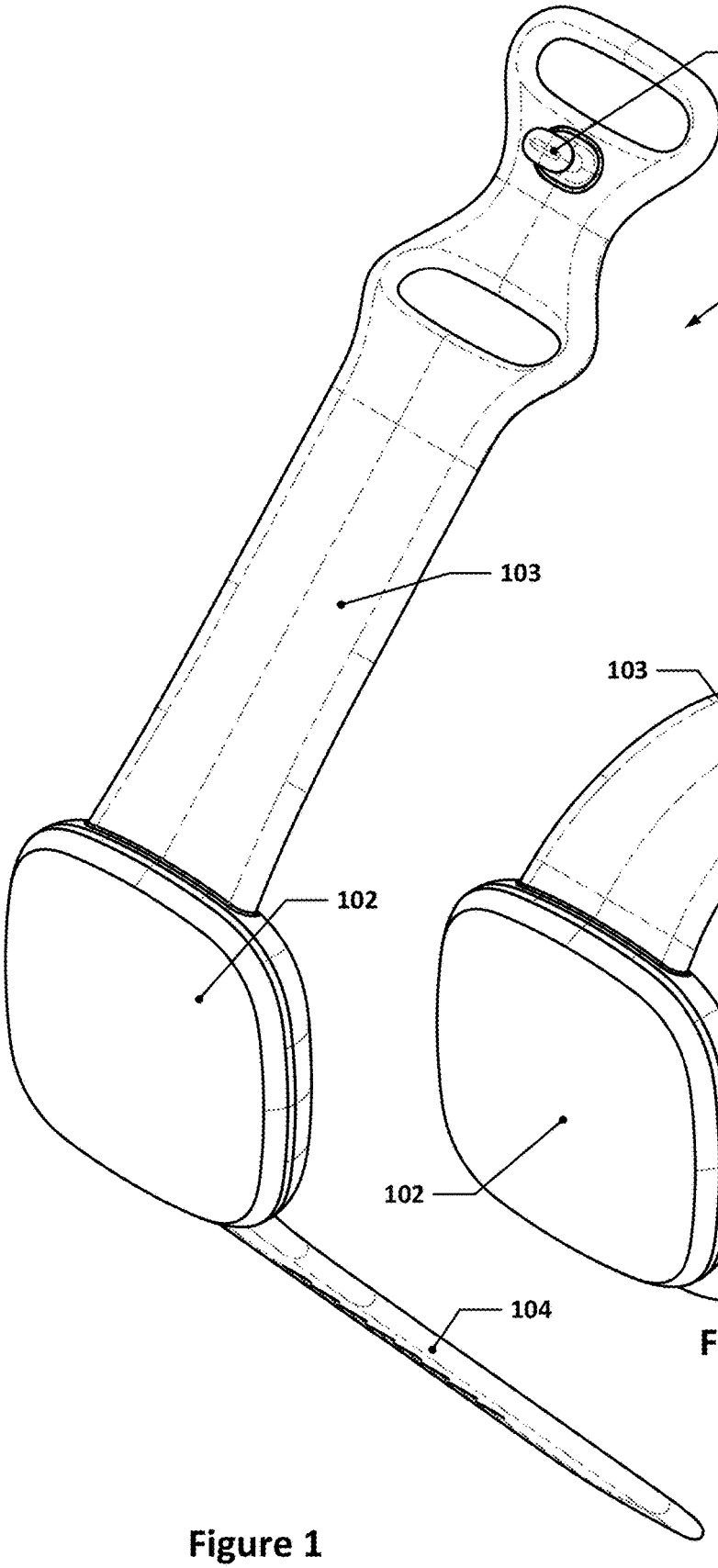
FIG. 1 depicts an isometric view of an example wearable device in an unclasped or unworn state.
Figure 2:
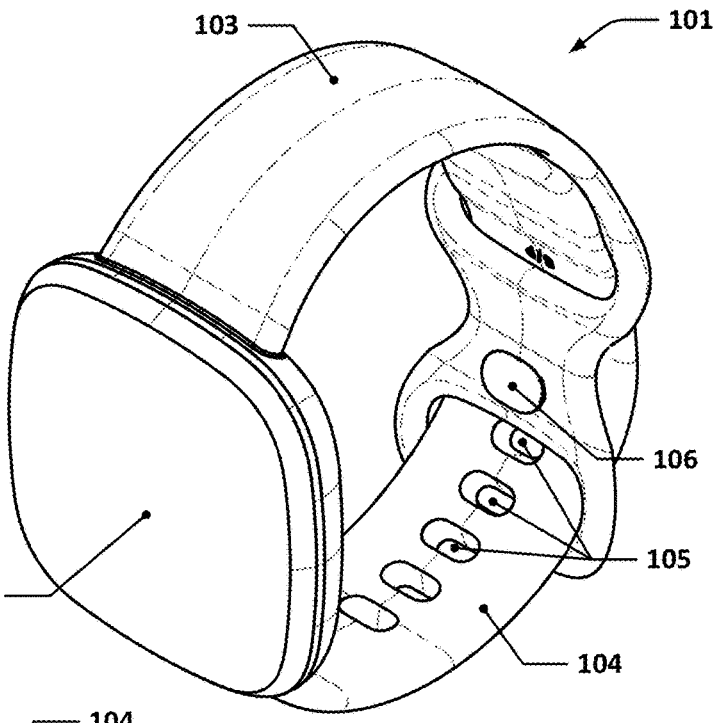
FIGS. 2 through 5 depict the example wearable device of FIG. 1 in a clasped state, as it would be when worn, from various angles.
Figure 3:
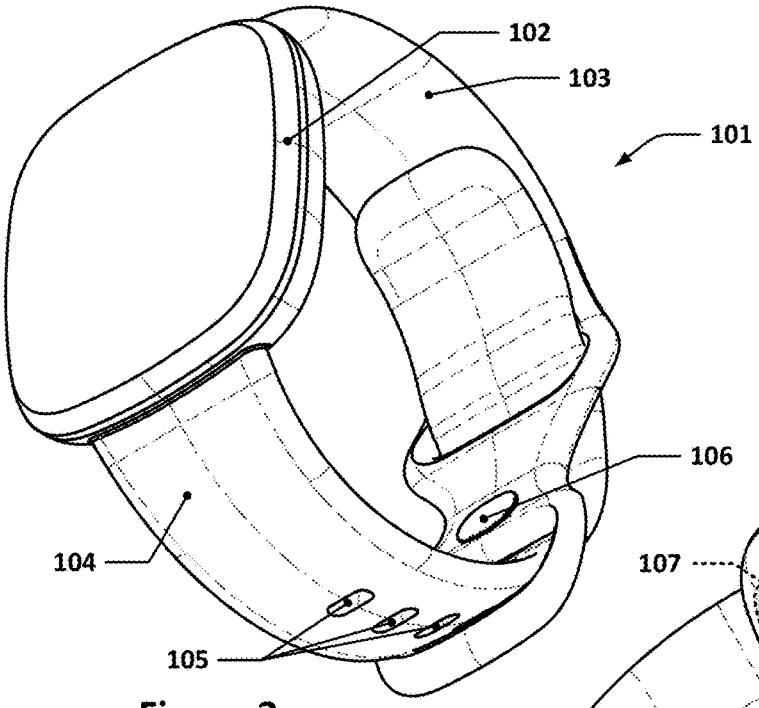

FIG. 1 depicts an isometric view of an example wearable device in an unclasped or unworn state. FIGS. 2 through 5 depict the example wearable device of FIG. 1 in a clasped state, as it would be when worn, from various angles.

As can be seen in FIGS. 1 through 5, a limb-wearable device 101 is shown. The limb-wearable device 101, which may also be referred to herein as simply a wearable device, may have a device housing 102 that has connected to it a strap 103 and an adjustment strap 104. The strap 103 and the adjustment strap 104 may both be made from an elastomeric material, such as hypoallergenic soft silicone, allowing the straps to compliantly bend relative to the device housing 102. In the example straps shown, the strap 103 has a particular construction that provides for a low-profile, extremely secure connection with the adjustment strap 104.

Such a connection may be provided, for example, through the use of a peg 106 that is inserted through the strap 103 such that it is very difficult to remove, making it effectively a semi-permanent part of the strap 103, and a plurality of adjustment holes 105 in the adjustment strap 104. The adjustment holes 105 may be placed at different, spaced-apart locations along the adjustment strap 104; the peg 106 may be inserted through any one of the adjustment holes 105 as needed to adjust the circumference of the straps when the straps are latched together.

Figure 4:
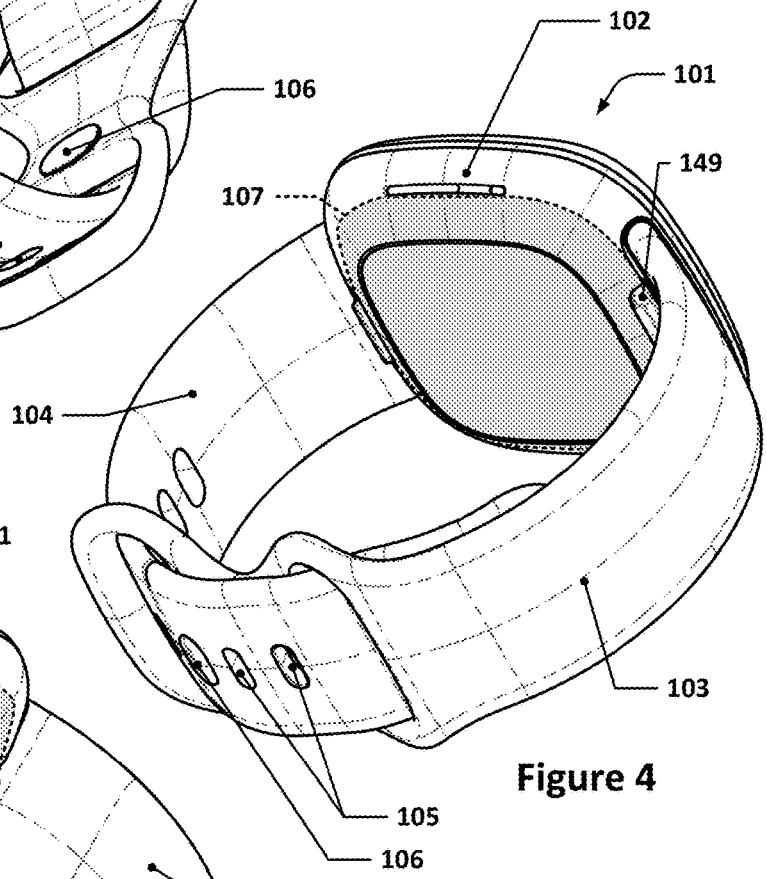
Figure 5:
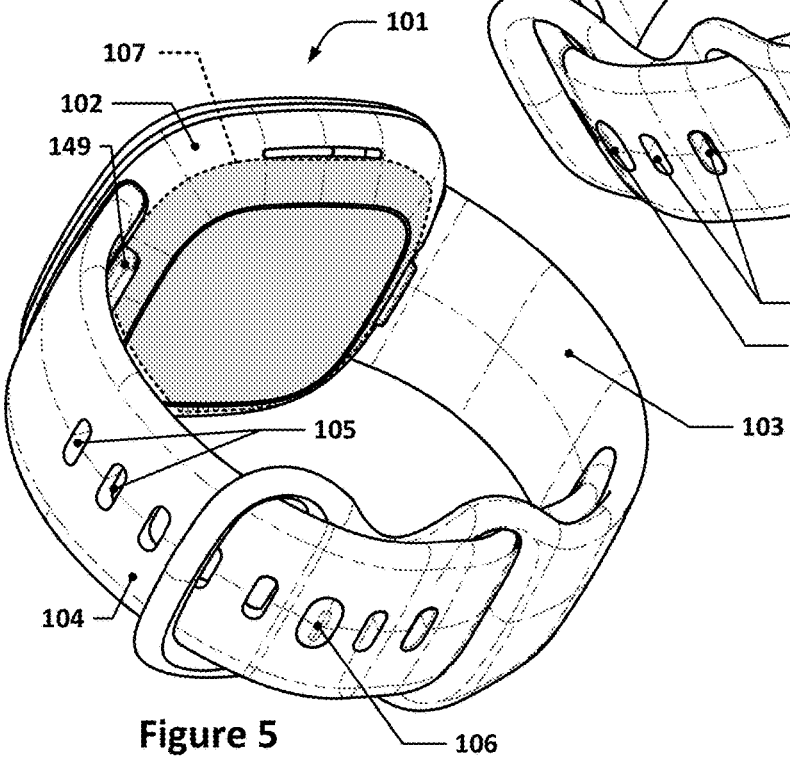

In FIGS. 4 and 5, a bottom surface 107 of the device housing 102 is visible. In between the device housing 102 and the strap 103 and the adjustment strap 103 can be seen the latching mechanisms of the device housing 102. Due to the largely concealed nature of the latching mechanisms, the only truly visible parts thereof in FIGS. 4 and 5 are release buttons 149.

Figure 6:
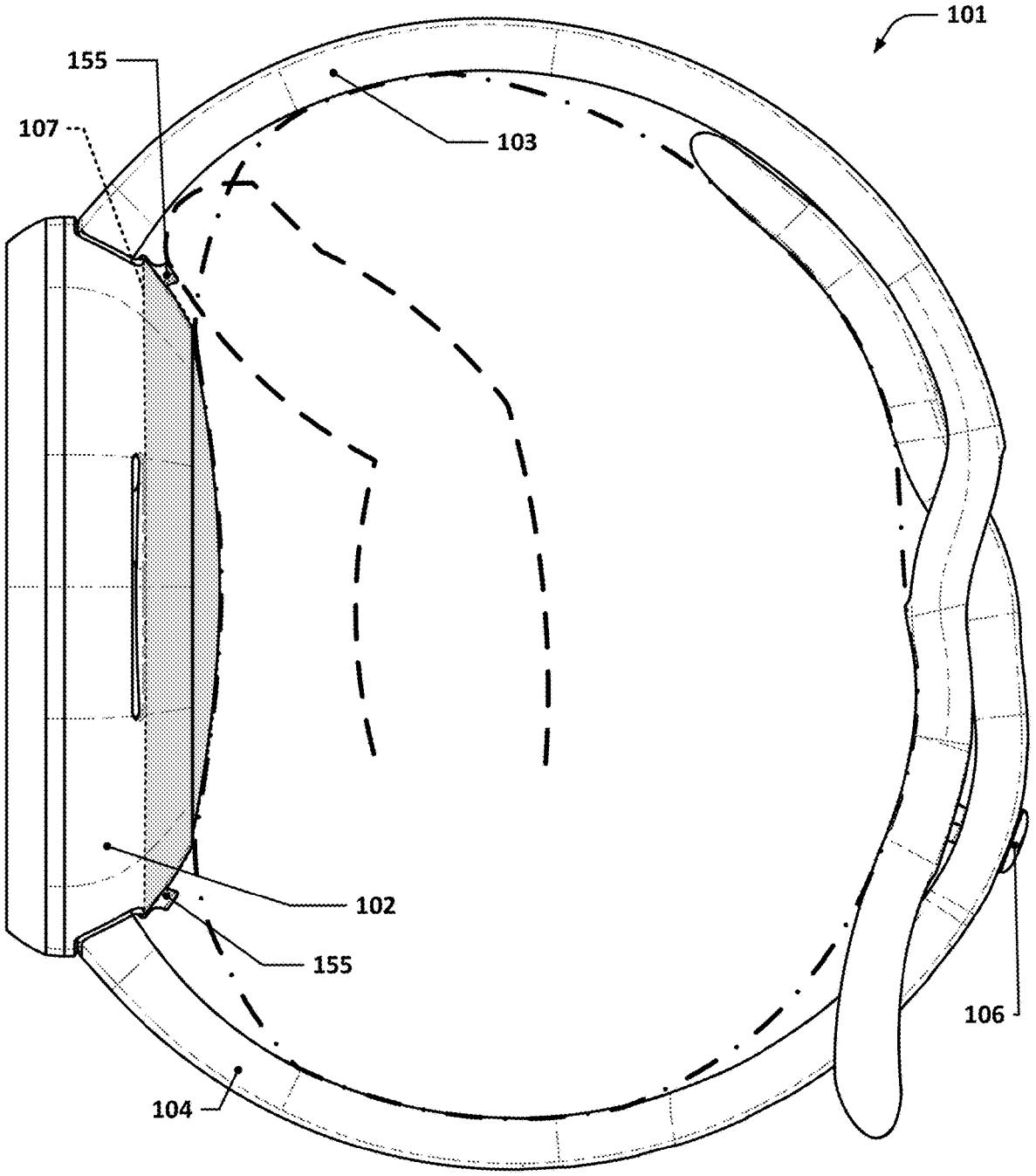
FIG. 6 depicts a side view of the example wearable device of FIG. 1 in the clasped state, highlighting a double-crossover feature of the example elastomeric straps shown in this implementation.

FIG. 6 depicts a side view of the example wearable device of FIG. 1 in the clasped state, highlighting a double-crossover feature of the example elastomeric straps shown in this implementation. As can be seen in FIG. 6, most of each release button 149 is hidden from view, with the exterior surface of the release buttons 149 being generally flush with the bottom surface 107. Each release button 149 may have a protrusion 155 that extends slightly from the exterior surface of the release button 149, e.g., between 0.5 mm and 1 mm in some implementations, e.g., 0.66 mm. The protrusion 155, as can be seen, is located in a region that, when the limb-wearable device 101 is worn on a limb, is free from contact with the wearer's skin (represented by the dash-dot-dash outline in FIG. 6), but is sized large enough that when the limb-wearable device 101 is removed from the wearer's limb, the tip of a finger (represented by the dashed outline in FIG. 6) may be placed against the protrusion and used to draw the protrusion towards the center of the device housing 102 to release the latching mechanism, as will be discussed in more detail later herein.

Figure 7:
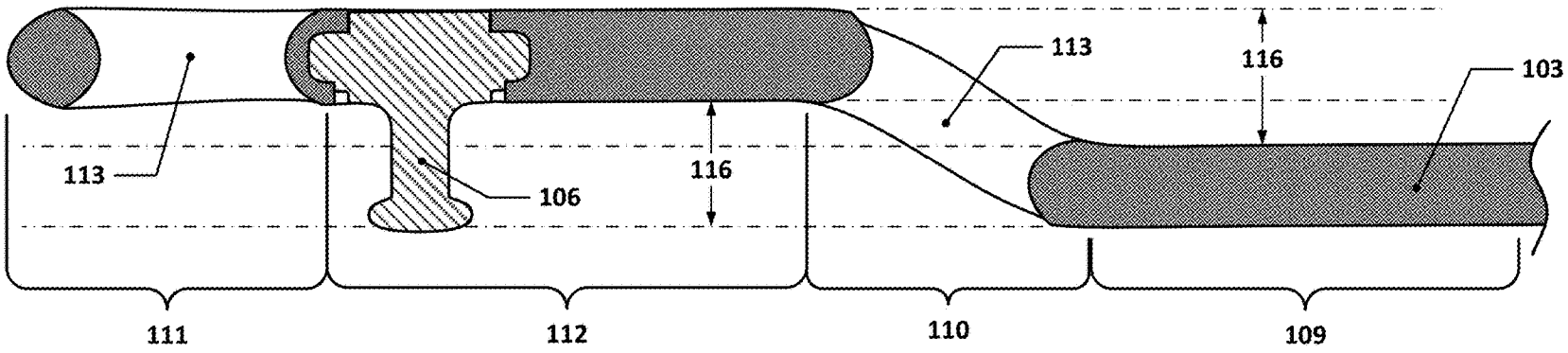
FIG. 7 shows a partial side section view of the double-crossover feature of the elastomeric strap of FIG. 6.
Figure 9:
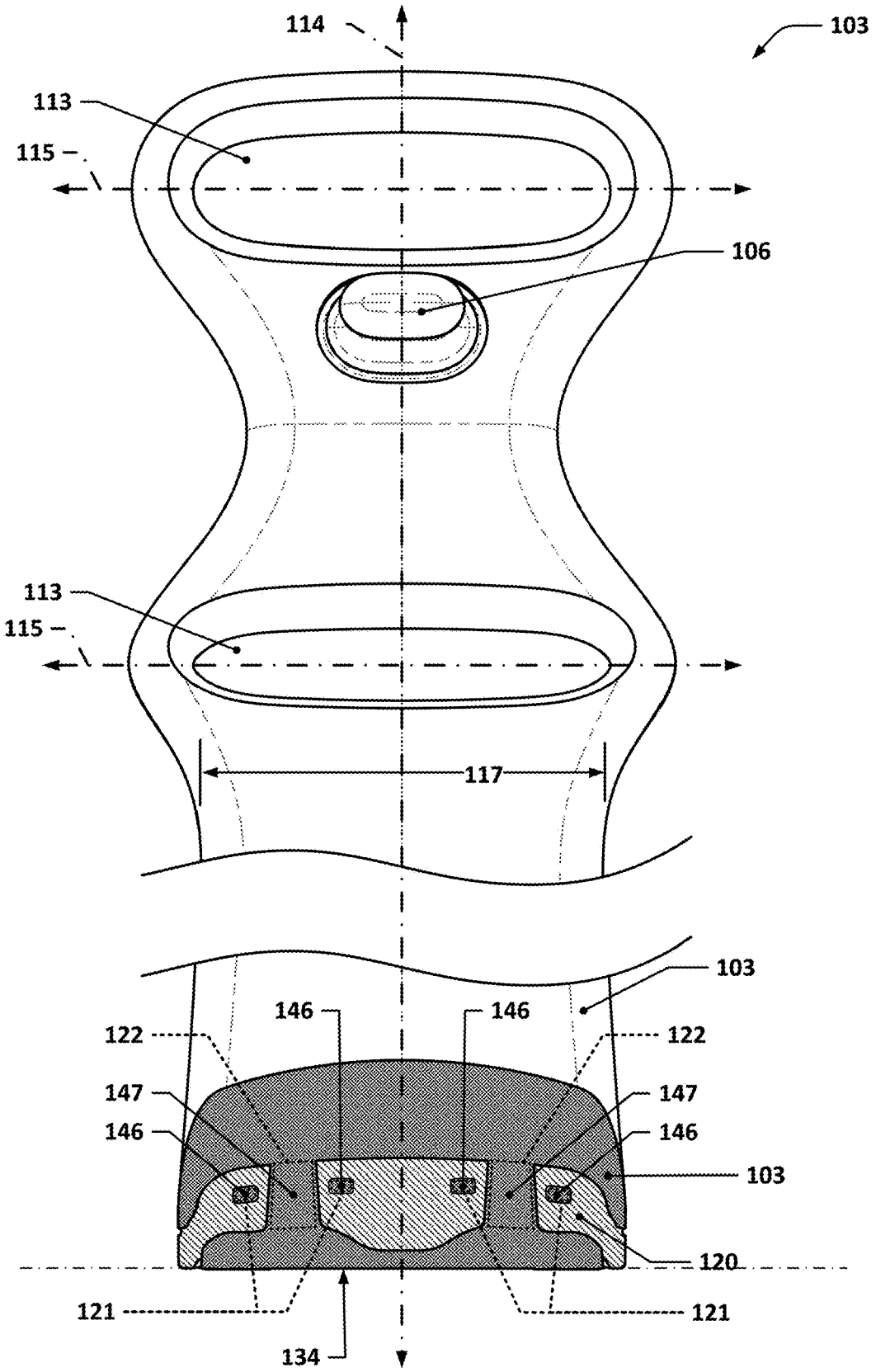
FIG. 9 depicts a partial section view of a portion of the elastomeric strap of FIG. 7 showing internal features of a rigid insert that is located at one end of the strap and the structure of the double-crossover feature of the strap.

While many different types of elastomeric straps may be used with devices such as wearable device 101, the elastomeric straps shown in FIGS. 1 through 6 feature a unique construction that has a double-crossover feature that may be used to latch the strap 103 to the adjustment strap 104. FIG. 7 shows a partial side section view of the double-crossover feature of the elastomeric strap of FIG. 6. FIG. 9 depicts a partial section view of a portion of the elastomeric strap of FIG. 7 showing internal features of a rigid insert that is located at one end of the strap and the structure of the double-crossover feature of the strap.

As can be seen from FIGS. 6, 7, and 9, the strap 103 may have a main portion 109 that extends to the device housing 102, a first pass-through portion 110, a second pass-through portion 111, and a peg portion 112 interposed between the first pass-through portion 110 and the second pass-through portion 111. The peg 106 may have a base that is inserted into the peg portion 112 near the second pass-through portion 111, and the first pass-through portion 110 and the second pass-through portion 111 may both have elongate holes 113 may have a long axis 115 that is perpendicular to a strap axis 114 along which the main portion 109, the first pass-through portion 110, the second pass-through portion 111, and the peg portion 112 are all arranged and transversely centered on.

The elongate holes 113 may each have a width along the long axis 115 that is slightly larger than, or generally the same size as, a strap width 117 of the adjustment strap 104 (the strap width 117 shown is for the strap 103, but the adjustment strap 104 may have an analogous strap width), thereby allowing the adjustment strap 104 to be passed through both the first pass-through portion 110 and the second pass-through portion 111, as shown in FIG. 6. As can be seen, the adjustment strap 104 may be passed through the second pass-through portion 111 from the side of strap 103 that faces towards the wearer's wrist, passed over the outward-facing surface of the peg portion 112, and back through the first pass-through portion 110 such that the free end of the adjustment strap 104 is trapped between the strap 103 and the wearer's skin when worn. This prevents the free end of the adjustment strap 104 from potentially snagging on clothing, straps, or other obstacles when the limb-wearable device 101 is being worn. At the same time, the peg 106 may be inserted through one of the adjustment holes 105 that overlap with the peg portion 112—any tensile loading of the fastened straps may generally cause the adjustment strap 104 overlapping with the peg portion 112 to be drawn into tighter contact with the peg portion 112 (and the peg 106) by virtue of being threaded through the first pass-through portion 110 and the second pass-through portion 111 on either side of the peg portion 112, thereby making it more difficult for the peg 106 to be removed from the adjustment hole 105 in which it is placed.

As can be seen in FIG. 7, there may be an offset 116 between the main portion 109 and the peg portion 112/second pass-through portion 111. The offset 116 may be such that when the strap 103 is in a largely undeformed state, i.e., in a relaxed state, a plane defined by the outward-facing surfaces of the peg portion 112/second pass-through portion 111 is generally parallel to a plane defined by the outward-facing surface of the main portion 109, but is offset therefrom by a distance between one and two times the thickness of the adjustment strap, e.g., approximately 1.4 to 1.6 times the thickness of the adjustment strap 104. This may allow the adjustment strap 104 to pass through the first pass-through portion 110 while also remaining generally parallel to the strap 103 on either side of the first pass-through portion 110. The terminal end of the strap 103 that forms a "crossbar" that defines one side of the second pass-through portion 111, however, may generally be kept co-planar with the peg portion 112 when in a relaxed state, thereby causing the crossbar portion to press against the adjustment strap 104 with greater force when the adjustment strap is passed through the second pass-through portion as shown in FIG. 6. This reduces the chance that the crossbar portion will snag on clothing or other obstacles, which may damage the strap.

Figure 8:
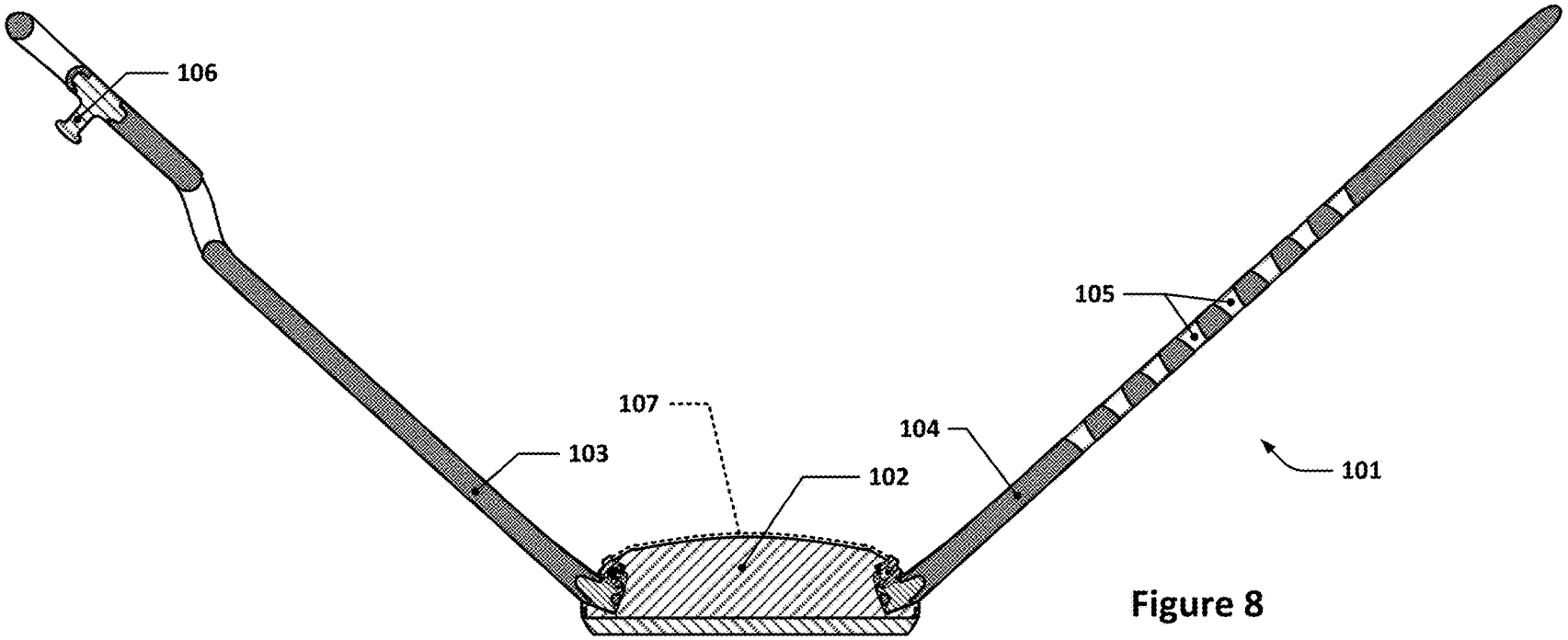
FIG. 8 depicts a side section view of the example wearable device of FIG. 1.

FIG. 8 depicts a side section view of the example wearable device of FIG. 1. As can be seen in FIG. 8, the strap 103 and the adjustment strap 104 are both connected with the device housing 102 through insertion into a latching receptacle that occupies a relatively small portion of the cross-sectional volume of the device housing 102. To facilitate such an interconnection, the strap 103 and the adjustment strap 104 may each have a rigid insert 120 embedded within the strap material, as shown in the bottom part of Figure #APP. For straps 103 and adjustment straps 104 that are made of an elastomeric material, the rigid insert 120 may include a plurality of first holes 121 that extend through the rigid insert 120 in directions generally parallel to a first surface 134 of the rigid insert 120 that forms the butt end of the strap 103 that is inserted into the device housing 102, e.g., in a direction normal to the page of FIG. 9. Elastomeric material from the strap 103, for example, may pass through the first holes 121 to form first bridging portions 146 that span between the elastomeric material on both sides of the first holes 121. Each end of the first bridging portions 146 may, for example, be connected with corresponding ends of other first bridging portions 146 by a continuous span of the elastomeric material that spans between them. The rigid insert 120 of FIG. 9 also includes second holes 122 that pass through the rigid insert 120 along directions generally perpendicular to the first surface 134. Second bridging portions 147 may correspondingly pass through the second holes 122 in a manner similar to how the first bridging portions 146 pass through the first holes 121. As can be seen, the two second bridging portions shown in FIG. 9 each have a first end (the "upper" end with respect to the orientation of the Figure) that is connected with the first end of the other second bridging portion 147 by a span of elastomeric material, and a second end (the "lower" end with respect to the orientation of the Figure) that is connected with the second end of the other second bridging portion 147 by a continuous span of elastomeric material. Thus, in the example rigid insert 120 of FIG. 9, the rigid insert 120 and the elastomeric material of the strap 103 are locked together, in effect, by two sets of generally orthogonal bridging portions, some (the second bridging portions 147) extending in a direction generally aligned with the strap axis 114, and the others (the first bridging portions 146) extending through the thickness of the strap 103. The first bridging portions 146 may thus act primarily to help prevent axial pull-out of the elastomeric material from the rigid insert 120, while the second bridging portions 147 may act primarily to help prevent rotational shear between the elastomeric material and the rigid insert 120.

Figure 10:
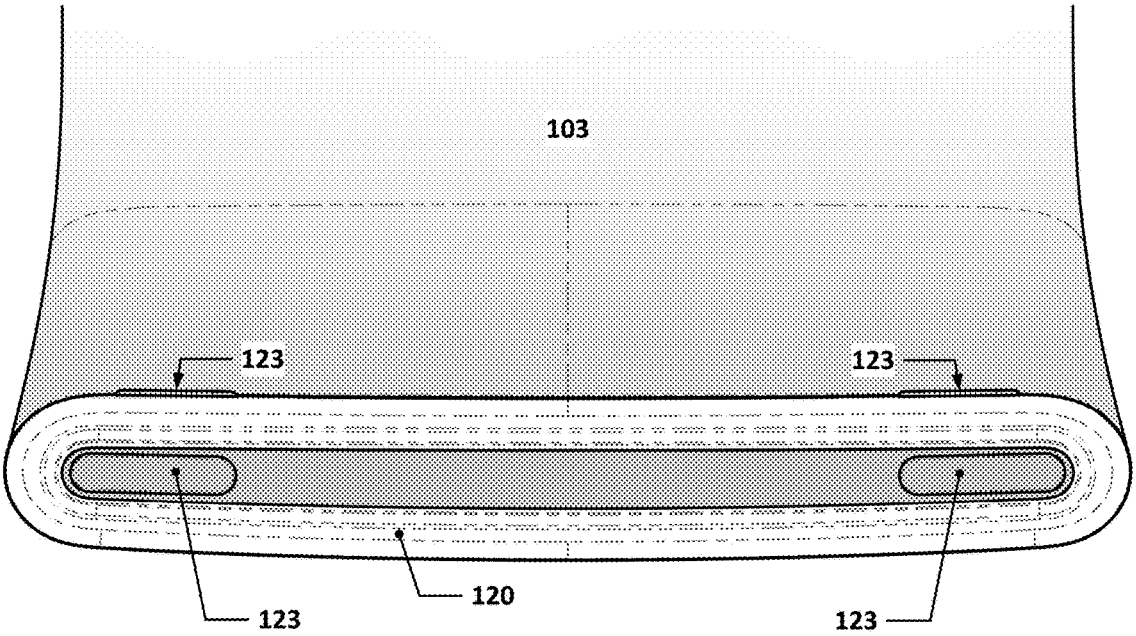
FIG. 10 depicts a partial end view of the elastomeric strap of Figure #9.

FIG. 10 depicts a partial end view of the elastomeric strap of Figure #9. In FIG. 10, the elastomeric material of the strap 103 is shown shaded in grey, while the rigid insert 120 is shown unshaded. As can be seen, there is a continuous span of elastomeric material that is located within a generally obround area within the rigid insert 120, bridging between the two second bridging portions 147 discussed with respect to FIG. 9. Also visible in FIG. 10 are four bumpers 123, which are portions of the elastomeric material that pass through or protrude past the outer surface of the rigid insert 120 by a small distance, e.g., 0.05 mm to 0.1 mm, and may act as compressible compliance absorbers that may, when the rigid insert 120 is inserted into a latching receptacle, contact the side walls of the receptacle and then compress slightly to give a snug fit with no loose mechanical play. In the depicted example, there are two bumpers 123 that are located at the butt end of the rigid insert 120 that may act to absorb compliance along a direction normal to the first surface 134, and two bumpers 123 located on the upper surface, relative to FIG. 10, of the rigid insert 120 to absorb compliance through the thickness of the rigid insert 120.

Figure 11:
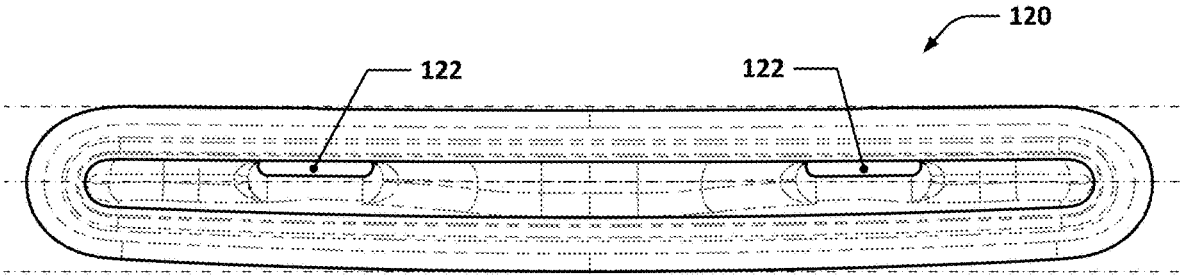
FIG. 11 depicts an example rigid insert that may be provided at the end of an elastomeric strap in order to interface with a latching mechanism similar to those disclosed herein; the rigid insert and the orientation of the view in FIG. 11 is the same is that of FIG. 10, but with the elastomeric strap material removed.

FIG. 11 depicts an example rigid insert that may be provided at the end of an elastomeric strap in order to interface with a latching mechanism similar to those disclosed herein; the rigid insert and the orientation of the view in FIG. 11 is the same is that of FIG. 10, but with the elastomeric strap material removed. The second holes 122 are more clearly visible (although partially obscured) in FIG. 11.

FIG. 11 also includes several horizontal dash-dot-dash lines that are included to help demonstrate that the rigid insert 120, in this particular implementation, has an exterior surface with an arcuate obround profile when viewed along a direction perpendicular to the first surface 134, i.e., when viewed end-on. For clarity, an obround is a shape or profile having the characteristics of spaced-apart semicircles that are joined together by parallel, non-collinear lines that are each tangent to a different endpoint of both semicircles, e.g., a shape such as a running track. An arcuate obround is a shape or profile similar to an obround, except that the linear segments are instead shallow arcs or shallow non-linear curves, with one segment having a concave aspect and the other having a convex aspect. Finally, a hybrid obround, as the term is used herein, refers to a shape or profile that is a blend of an obround and an arcuate obround, with one of the segments being linear (as in an obround) and the other being arcuate or curved and having a convex aspect.

The arcuate obround profile of the rigid insert 120 of FIG. 11 is fairly subtle, although when the upper profile of the rigid insert 120 (relative to the orientation of FIG. 11) is compared against the dash-dot-dash line that is adjacent thereto, it can clearly be seen that the upper profile is slightly concave, while comparison of the lower profile of the rigid insert 120 (again, relative to the orientation of FIG. 11) is compared against the dash-dot-dash line that is adjacent thereto, it can clearly be seen that the lower profile is slightly convex. In some implementations, the upper and lower profiles may be identical/complementary in shape, while in others, there may be a small amount of variation between the two profiles. While the amount of curvature in the arcuate obround is subtle, the curvature may nonetheless act to prevent the rigid insert 120 from being inserted into the corresponding latching receptacle incorrectly, e.g., upside down.

It will be understood that while the rigid insert 120, as shown, has an outermost cross-sectional boundary in a plane parallel to the first surface 134 that is generally an arcuate obround in shape, other rigid inserts consistent with this disclosure may have shapes that have other outermost cross-sectional boundaries, although such other outermost cross-sectional boundaries may generally each be inscribed within a boundary region that is generally an obround, arcuate obround, or hybrid obround in shape.

Figure 12:
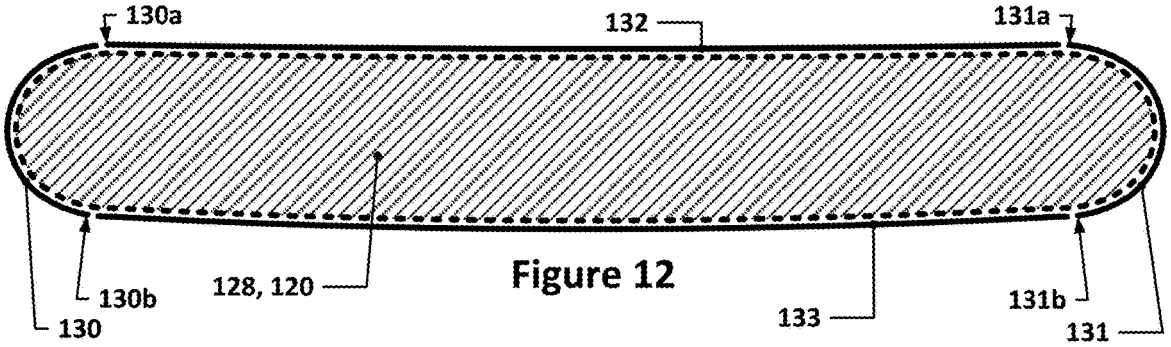
FIG. 12 depicts an example boundary region.

FIG. 12 depicts an example of such a boundary region. In FIG. 12, a boundary region 128 is shown that is, in this example, generally coincident with the outermost cross-sectional boundary of the rigid insert 120; the boundary region has a boundary represented by a dotted line. The boundary of the boundary region 128 may be thought of as being defined by a first semicircle 130, a second semicircle 131, a first segment 132, and a second segment 133. The first segment 132 may, for example, span between, and be tangent to, first ends 130*a* and 131*a* of the first semicircle 130 and the second semicircle 131, respectively, and the second segment 133 may, for example, span between, and be tangent to, second ends 130*b* and 131*b* of the first semicircle 130 and the second semicircle 131, respectively.

As noted above, rigid inserts with other outermost cross-sectional boundaries than that of the rigid insert 120 may still be considered to be inscribed within the boundary region 128 shown. As used herein, reference to a shape or profile in a plane being inscribed within a boundary region in that plane refers to a an arrangement where a) the shape or profile cannot be moved, either in translation parallel to the plane or rotation about an axis normal to the plane, without at least a portion of the shape or profile crossing over the boundary that defines the boundary region and b) the shape or profile contacts the boundary of the boundary region at three or more points but does not cross out of the boundary region. To assist in further understanding of this concept, outermost cross-sectional boundaries of several alternate rigid insert shapes are shown in the following Figures relative to the boundary region 128.

Figure 13:
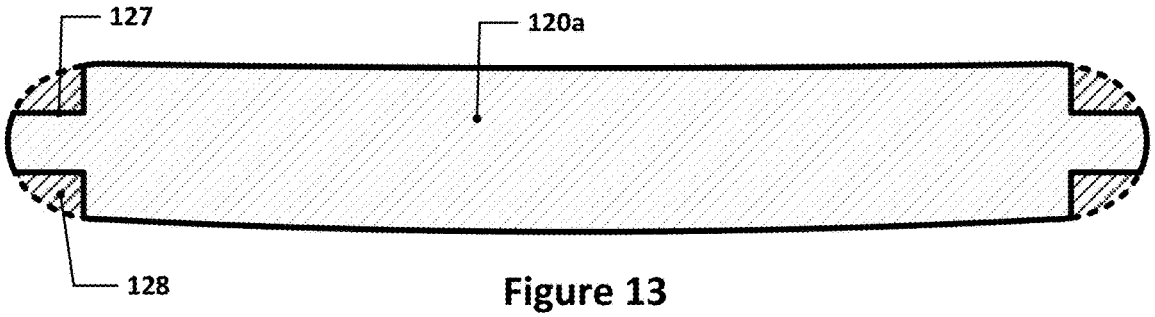
FIG. 13 depicts the example boundary region of FIG. 12 with the outermost cross-sectional boundary of an example rigid insert inscribed therein.

FIG. 13 depicts the example boundary region of FIG. 12 with the outermost cross-sectional boundary of an example rigid insert inscribed therein. In FIG. 13, a rigid insert 120*a* is shown that is largely similar in cross-section to the rigid insert 120, except that there are four "corner" cutouts provided, as shown. As can be seen, however, the rigid insert 120*a* has an outermost cross-sectional boundary that is still inscribed within the boundary region 128, i.e., it touches the boundary region at three or more locations but does not cross the boundary region 128, and cannot be moved within the plane of FIG. 13 without crossing at least partially out of the boundary region 128.

Figure 14:
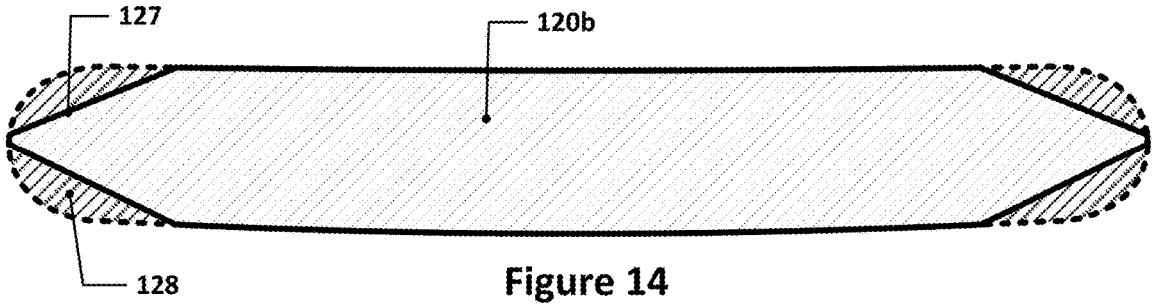
FIG. 14 depicts the example boundary region of FIG. 12 with the outermost cross-sectional boundary of another example rigid insert inscribed therein.
Figure 15:
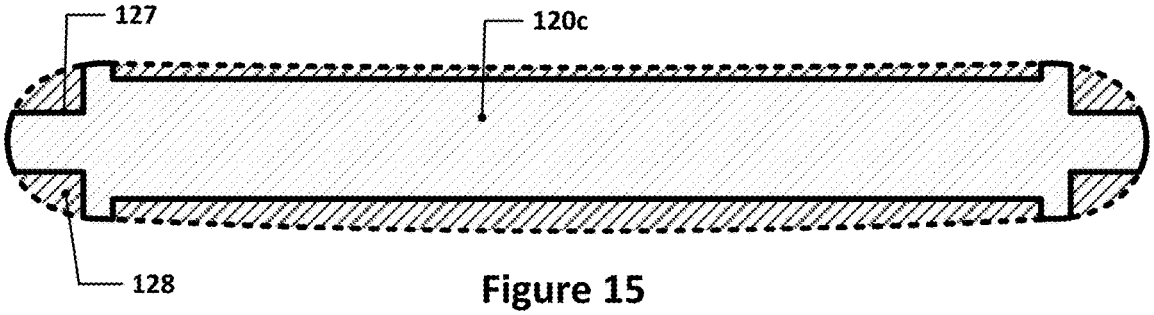
FIG. 15 depicts the example boundary region of FIG. 12 with the outermost cross-sectional boundary of yet another example rigid insert inscribed therein.

FIG. 14 depicts the example boundary region of FIG. 12 with the outermost cross-sectional boundary of another example rigid insert inscribed therein. As with the outermost cross-sectional boundary of the rigid insert 120*a*, the outermost cross-sectional boundary of rigid insert 120*b* is also inscribed within the boundary region 128. FIG. 15 depicts the example boundary region of FIG. 12 with the outermost cross-sectional boundary of yet another example rigid insert inscribed therein. Again, as with the outermost cross-sectional boundary of the rigid insert 120*a*, the outermost cross-sectional boundary of rigid insert 120*c* is also inscribed within the boundary region 128. It will be understood that there may be a variety of such outermost cross-sectional boundary shapes that may be describable as being inscribed within a boundary region such as the boundary region 128, and that reference to rigid inserts as having such an outermost cross-sectional boundary is to be understood as being inclusive of all rigid inserts having such an outermost cross-sectional boundary.

The boundary regions applicable to rigid inserts discussed herein may be generally obround, and may include, for example, arcuate obrounds, or hybrid obrounds.

Figure 16:
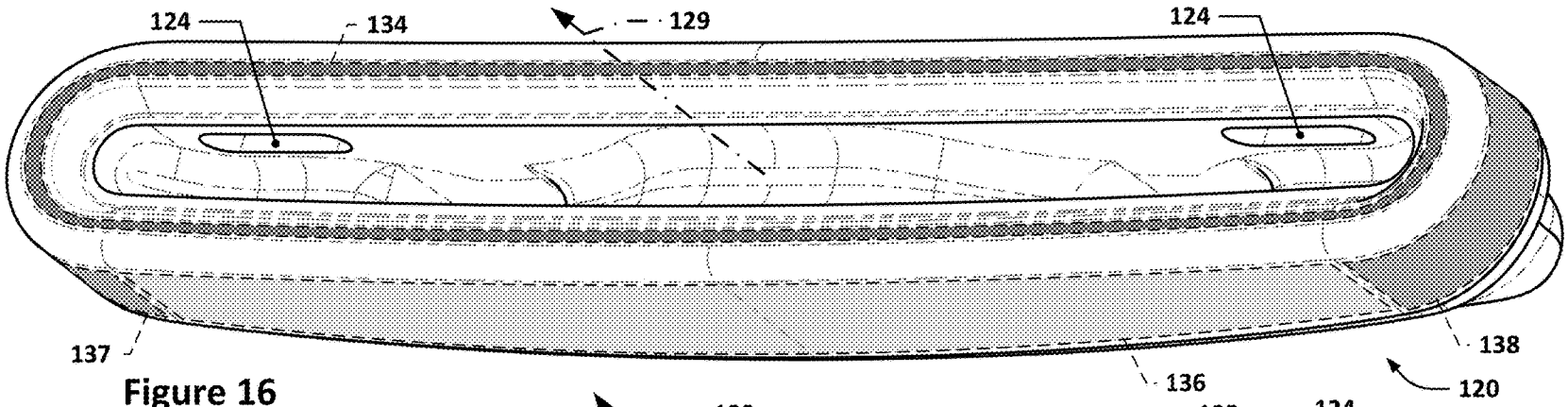
FIG. 16 depicts a perspective view of the example rigid insert of FIG. 11.
Figure 17:
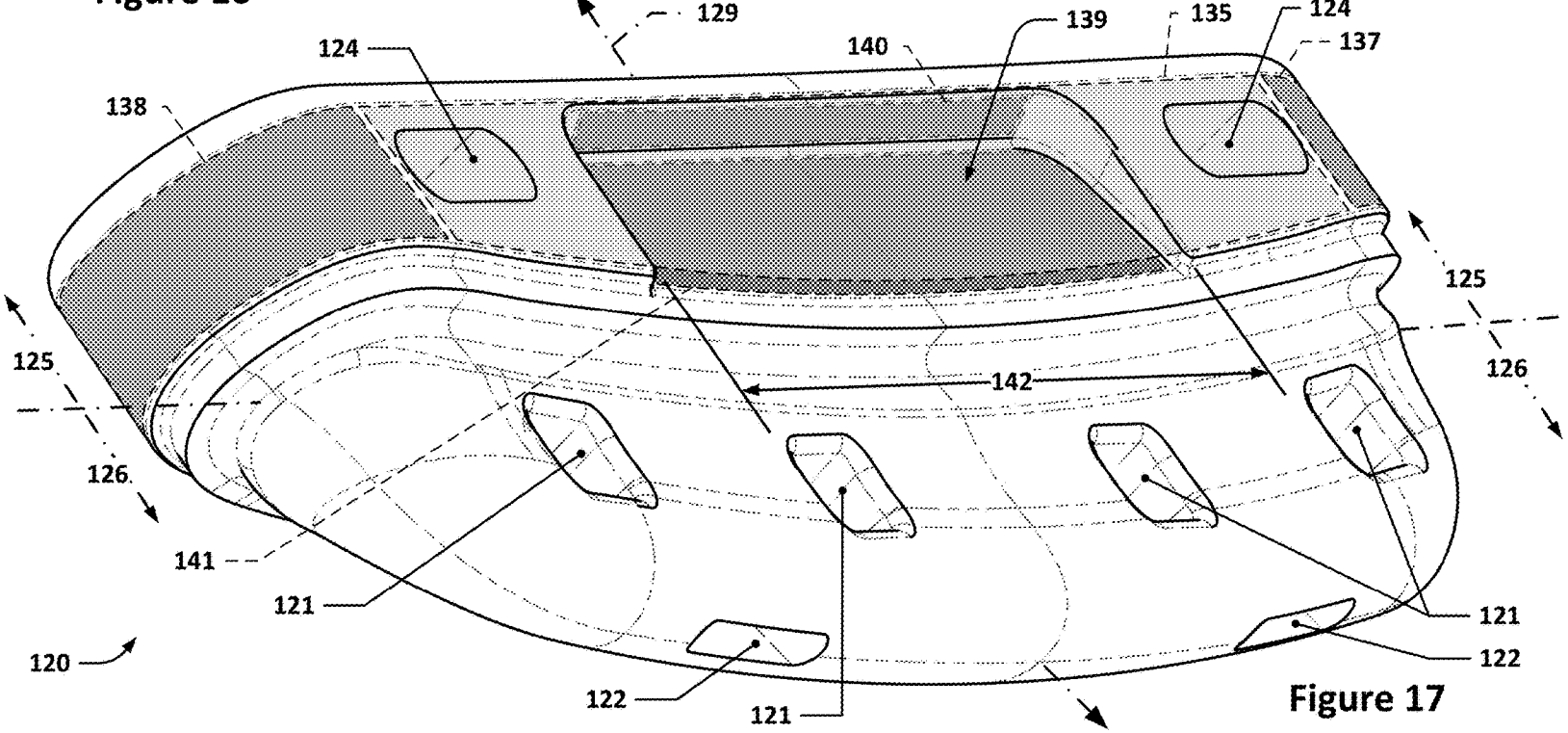
FIG. 17 depicts another perspective view of the example rigid insert of FIG. 11.

FIG. 16 depicts a perspective view of the example rigid insert of FIG. 11; FIG. 17 depicts another perspective view of the example rigid insert of FIG. 11. As shown in FIGS. 16 and 17, the rigid insert 120 may have an insertion portion 125 that is defined, at least in part, by a number of surfaces, such as the first surface 134 discussed earlier (which, in this example, is an obround region with an obround interior region removed). Additional surfaces that may further define the insertion portion may include, for example, a second surface 135, a third surface 136, a first endcap surface 137, and a second endcap surface 138. As can be seen in FIGS. 16 and 17, the second surface 135, the third surface 136, the first endcap surface 137, and the second endcap surface 138 may, in some implementations, form a generally obround profile, although other implementations may feature differently arranged surfaces to arrive at other profiles, such as those discussed with respect to FIGS. 13 through 15.

Also visible in FIGS. 16 and 17 are a first axis 129 and two bumper ports 124. The first axis 129 may be perpendicular to the first surface 134, and may generally define an insertion direction for the rigid insert when being inserted into a corresponding latching receptacle on the device housing 102. The first surface 134 may be interposed between the second surface 135 and the third surface 136, as well as between the first endcap surface 137 and the second endcap surface 138, when viewed along the first axis 129. The bumper ports 124 may, in some implementations, be provided to allow elastomeric material to flow through the rigid insert 120 and to protrude from the exterior surface of the rigid insert slightly so as to be proud of the rigid insert exterior surface, as discussed earlier.

The rigid insert 120 may also include a recess 139 that is located in the second surface 135. The recess 139 may be defined by a plurality of surfaces, including a latching surface 140 and a floor surface 141. The latching surface 140 may come into contact with an engagement surface of the release button 149 (see later discussion) for a corresponding latching mechanism of a latching receptacle on the device housing 102, thereby acting as the primary interface through which pull-out loading on the strap 103 is transmitted into the device housing 102 via the release button 149. The floor surface 141 may be provided to allow for clearance for a portion of the release button 149, and may have a first end that is proximate to the latching surface 140 and a second end that is proximate to the second surface 135. The recess 139 may have a width 142 that is sufficient to allow the release button 149 to protrude into the recess 139 so that the engagement surface of the release button can come into contact with the latching surface 140. In some implementations, the latching surface may have a width of 8 mm or more, e.g., 9.4 mm.

The latching surface 140 may generally extend from the second surface 135 towards the third surface 136. It will be understood that there may be a rounded transition surface in between the second surface 135 and the latching surface 140, but that such surfaces may nonetheless be said to virtually intersect each other (or that the latching surface 140 may extend "from" the second surface 135 even if separated from the second surface 135 by a rounded surface). For clarity, when two non-intersecting surfaces are said to virtually intersect at a location, the location is the equivalent of the intersection point between those surfaces if those surfaces were to extend beyond their actual extents and actually intersect each other. For example, two surfaces may intersect each other to form a hard edge, e.g., two adjacent sides of a cube may form an edge where they meet. If that edge is then rounded with a radius, the two surfaces will no longer intersect since the surface formed by the rounded edge will be interposed between them. However, the surfaces may still be said to virtually intersect at a location that corresponds with the location of the original edge. In some implementations, the latching surface 140 and the second surface 135 may virtually intersect at a location that is offset from the first surface 134 by a distance of between 0.35 mm and 0.6 mm in a direction perpendicular to the first surface 134, e.g., 0.45 mm or 0.42 mm.

The rigid insert 120 may also include a protrusion portion 126. The insertion portion 125 may generally be understood to be the portion of the rigid insert that is designed to be located entirely within the latching receptacle of the device housing 102 when the rigid insert is fully inserted into the device housing 102; the insertion portion 125 is generally completely obscured from view once inserted into the latching receptacle. In contrast, the protrusion portion 126 may generally be understood to be the portion of the rigid insert that is located outside of the latching receptacle of the device housing 102 when the insertion portion 125 is fully inserted into the latching receptacle. At least a portion of the protrusion portion 126 may have a smaller outermost cross-sectional shape than that of the insertion portion 125 so as to allow elastomeric material to flow around at least a portion of the protrusion portion 126. The protrusion portion 126 may also include the various first holes 121 and second holes 122 that may be present in the rigid insert 120.

Figure 18:
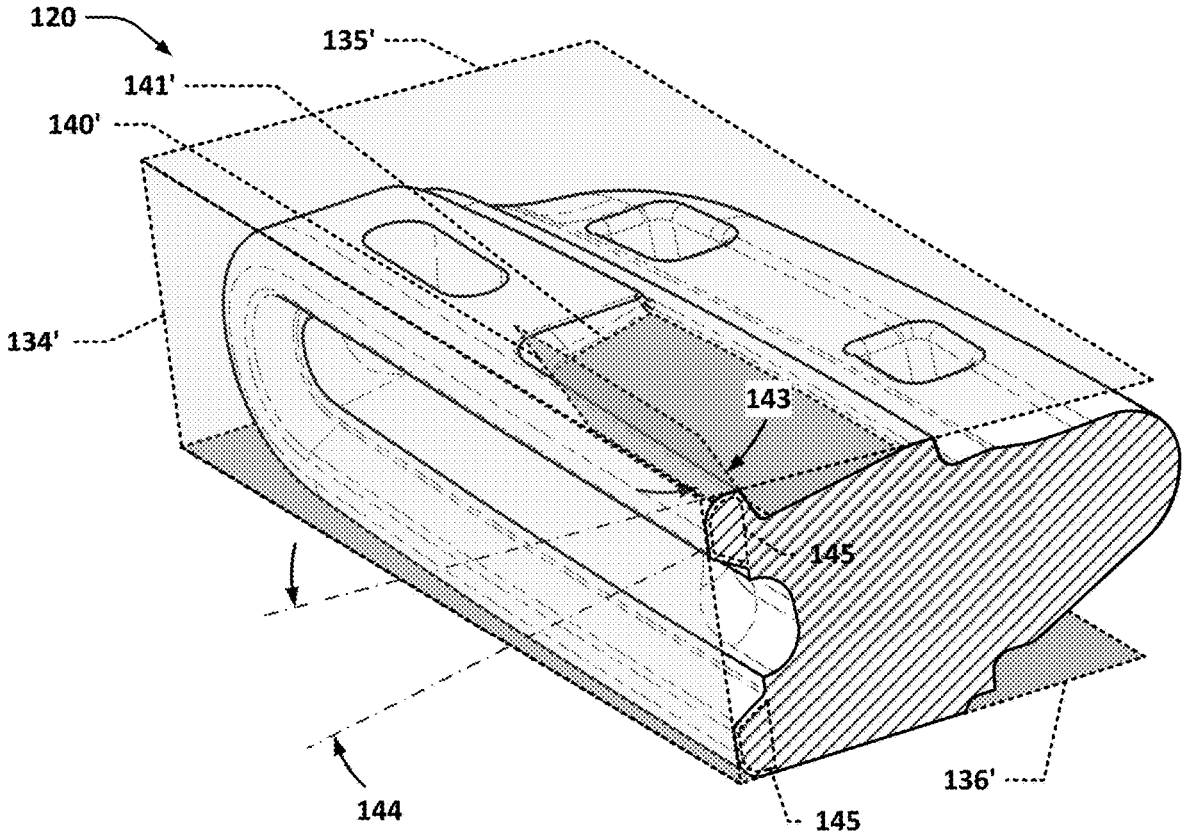
FIG. 18 is a perspective section view of the example rigid insert of FIG. 11.

FIG. 18 is a perspective section view of the example rigid insert of FIG. 11. As can be seen, the first surface 134, the second surface 135, the third surface 136, the latching surface 140, and the floor surface 141 may all generally define corresponding planes 134', 135', 136', 140', and 141', although it will be understood that, in some implementations, some or all of those surfaces may be non-planar, e.g., slightly convex or slightly concave, as discussed earlier. For example, the second surface 135 and the third surface 136 are, respectively, slightly concave (forming the concave part of an arcuate obround cross-sectional profile) and slightly convex (forming the convex part of the arcuate obround cross-sectional profile) but may nonetheless be thought of as defining planes, e.g., planes where the volume trapped between each plane and the respective second surface 135 or third surface 136 is minimized, or an average midplane of such a surface. Such planes may still be thought of as being generally parallel to such surfaces, however. As used herein, the phrase "generally parallel" refers to surfaces (or a surface and a plane) that are largely parallel to one another, although not necessarily exactly parallel. In particular, one of the surfaces may have a slight taper, e.g., less than about 2°, relative to an axis parallel to the other surface. Such surfaces may be true planar surfaces or may be curved or contoured surfaces that appear, to casual inspection, to generally be flat or almost flat, e.g., have a flatness per square centimeter of 1 mm or less. The phrase "generally perpendicular" is to be understood to be similarly defined, although with respect to perpendicularity rather than parallelism.

In the example rigid insert 120, both the second surface 135 and the third surface 136 are shown with slight tapers, e.g., the second surface 135 and the third surface 136 are both inclined relative to the first axis 129 by an angle of between 0° and 1°, e.g., between about 0.2° and 0.8, e.g., between about 0.4° and 0.6°, e.g., approximately 0.5°. It will be understood that "between" in the context of this disclosure and with reference to a range of values is used in the inclusive sense, i.e., it embraces not only the values between the stated endpoints of the range, but also the endpoints of the range themselves.

As can be seen in FIG. 18, the latching surface 140 may form an included angle 143 with the first surface 134. The first included angle 143 may be between about 20° and 50°, e.g., 25°, 28°, 35°, 40°, or 45° depending on the particular implementation. In the particular implementation of FIG. 18, the first included angle 143 may be between 26° and 30°, e.g., approximately 28°. Similarly, the floor surface 141 may form a second included angle 144 with the second surface 135 which may be between, for example, 5° and 30°, e.g., 8.7°, although it will be recognized that the floor surface may take any of a variety of forms and may not form any particular included angle with the second surface 135 in some implementations.

In some implementations, such as that shown in FIG. 18, the rigid insert 120 may have a low, circumferential wall 145 that generally follows the outermost cross-sectional boundary of the rigid insert 120; the "top" of the wall 145 may, in such implementations, provide the first surface 134 and may encircle, for example, a strip of elastomeric material that is located within the wall 145.

Figure 19:
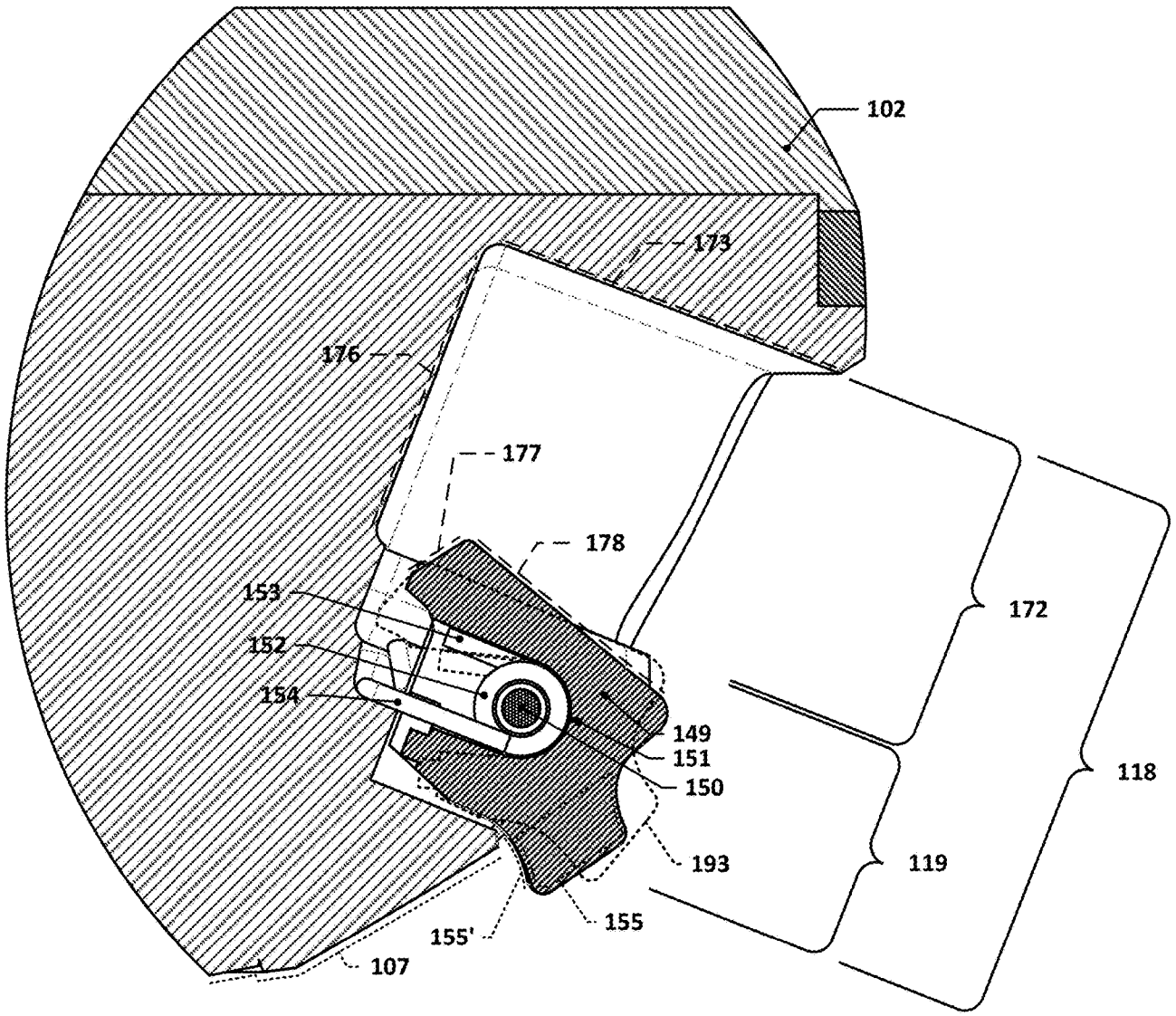
FIG. 19 is a side section view of the example device housing from FIG. 8 showing a detail view of a latching receptacle.

FIG. 19 is a side section view of the example device housing from FIG. 8 showing a detail view of a latching receptacle. As seen in FIG. 19, a latching receptacle 118 may include an opening 172 that is sized to receive a rigid insert 120 and a latching mechanism 119.

The latching mechanism 119 may include a number of components, including, for example, a release button 149, a first spring 151, and one or more axles 150. The release button 149 may be supported relative to the device housing 102 by the one or more axles 150, which may allow the release button 149 to rotate about a pivot axis relative to the device housing 102.

The first spring 151 may be a helical torsion spring having a coil portion 152, a first leg 153, and a second leg 154. The first leg 153 and the second leg 154 may both be portions of the spring wire that forms the coil portion 152 that extend tangentially outward from the coil portion and which provide mechanical multipliers for applying torque to the coil portion 152. The first leg 153 may, for example, be compressed against a surface of the release button 149, while the second leg 154 may be compressed against a surface of the device housing 102. Such compression may urge the release button 149 to rotate about the pivot axis in, per the orientation of FIG. 19, a clockwise manner. Such rotational movement, if it occurs, may cause an engagement surface 177 of the release button 149 to move into, or further into, the opening 172.

When the release button 149 is caused to rotate in the opposite direction, e.g., counterclockwise per the orientation of FIG. 19, this may cause the first spring 151 to be torsionally compressed. For example, the release button 149 may include the protrusion 155 that protrudes beyond the natural extension of the bottom surface 107 such that a user may engage the protrusion 155 with the tip of a finger or thumb, as discussed earlier. In some implementations, the protrusion 155 may have a concave surface 155' that facilitates better traction between a user's finger and the release button 149. In some implementations, the distance between the pivot axis of the release button 149 and the surface of the protrusion 155 that is furthest therefrom may be on the order of between 1.5 mm and 3 mm, which may provide sufficient leverage for a user to be able to easily manipulate the release button 149 while still providing a compact mechanism package.

The opening 172 may be defined by a number of surfaces and may, generally speaking, have a cross-sectional shape similar to that of the boundary region mentioned above for the corresponding rigid insert. For example, the opening 172 may be defined, at least in part, by a top surface 173, a floor surface 176, and a flank surface 178 of the release button 149. The flank surface 178 may be pivotable about the pivot axis of the one or more axles 150, along with the release button 149. As shown, the release button 149 can be pivoted between at least a first position 193 and a second position, e.g., the position shown in FIG. 19. In the first position 193, the flank surface 178 may be largely parallel to, e.g., within ±2° of, the top surface 173, thereby allowing the rigid insert 120 to be inserted into the opening 172. In the second position, the engagement surface 177 may be rotated towards the top surface 173 so that it protrudes into the opening and past where the flank surface 178 is located when the release button 149 is in the first position 193. In some implementations, the amount of rotation that the release button may be able to rotate through before bottoming out in either direction may, for example, be on the order of between 15° and 30°, e.g., between 15° and 20°, e.g., 17.5°, or between 20° and 30°, e.g., 24°. In some implementations, the shortest distance between the engagement surface 177 and the pivot axis of the release button 149 may be between 1.5 mm and 2 mm, which may, in combination with the above-mentioned rotational amounts, allow for sufficient rotational movement that the edge of the engagement surface 177 closest to the top surface 173 may move away or towards the top surface 173 by an amount of between 0.4 mm and 1.2 mm. This allows the engagement surface 177 to engage with the recess 139 of the rigid insert 120 by a similar amount—such "bite," while small, was found to be surprisingly effective at latching the strap accessories having the rigid insert 120 in place. In a related aspect, the included angle between the engagement surface 177 and the flank surface 178 within the release button 149 may, in some implementations, be between 100° and 145°, which may allow the engagement surface 177 to be generally tangential to the arc through which the engagement surface 177 rotates when the release button 149 is caused to rotate while at the same time allowing the flank surface 178 to be generally parallel to the second surface 135 of the rigid insert 120 during insertion of the rigid insert 120 into the latching receptacle 118, thereby allowing for clean insertion of the rigid insert 120 into the latching receptacle 118. The engagement surface may have a width along the release button 149 pivot axis that is between, for example, 7 mm and 11 mm in some implementations.

Figure 20:
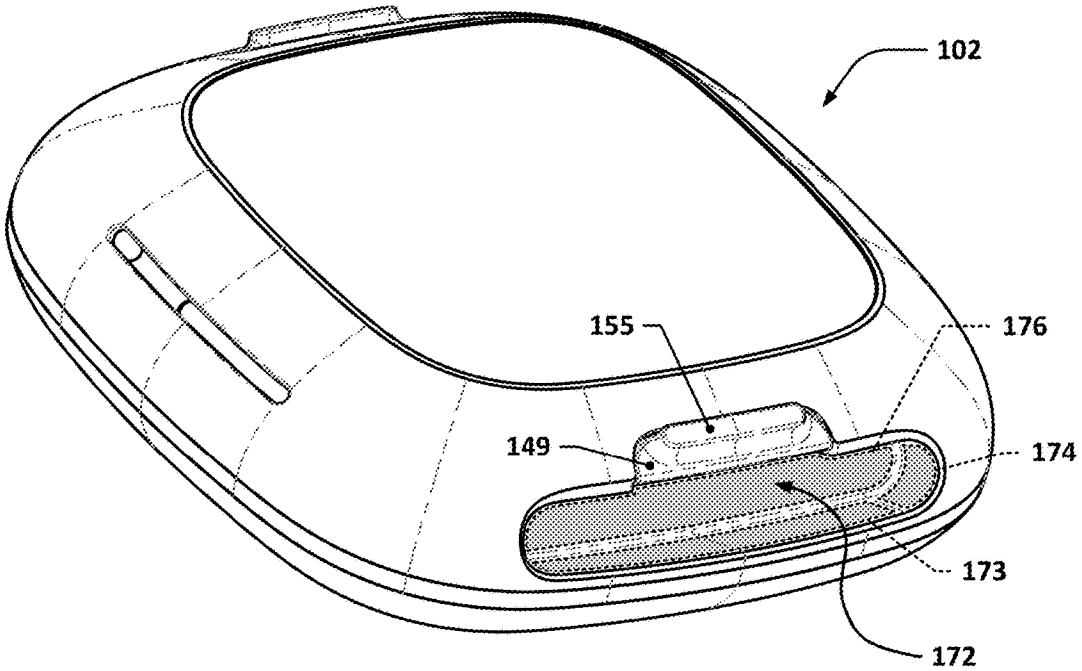
FIG. 20 is a perspective view of the device housing of FIG. 19.
Figure 21:
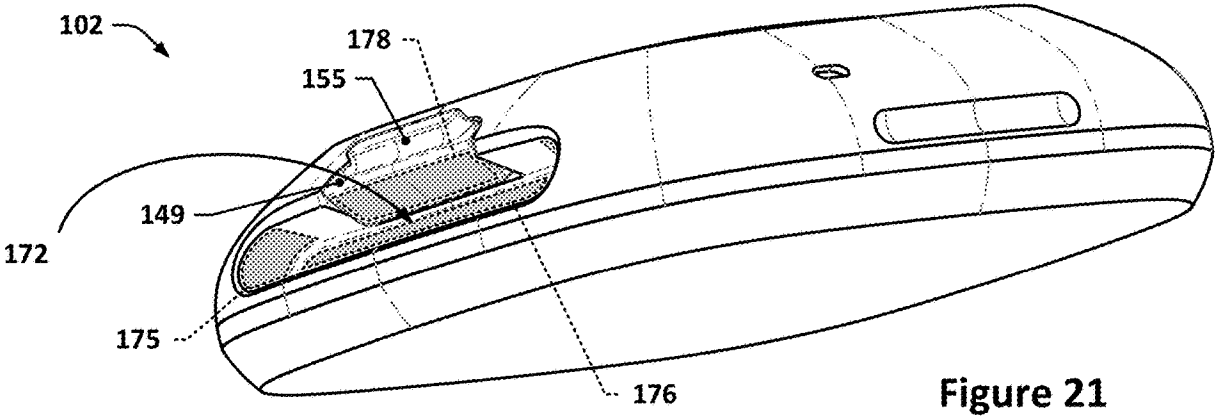
FIG. 21 is another perspective view of the device housing of FIG. 19.

FIG. 20 is a perspective view of the device housing of FIG. 19; FIG. 21 is another perspective view of the device housing of FIG. 19. As can be seen in FIGS. 20 and 21, the opening 172 may have an overall shape that is complementary to the rigid insert 120. As noted earlier, the opening 172 may be defined, at least in part, by the top surface 173 and the flank surface 178 of the release button 149. The opening 172 may also be defined by a first side surface 174 and a second side surface 175, which may be complementary to the first endcap surface 137 and the second endcap surface 138. In the implementation shown, the opening 172 has a cross-sectional shape that is generally obround in shape and matches the cross-sectional shape of the rigid insert 120.

Figure 22:
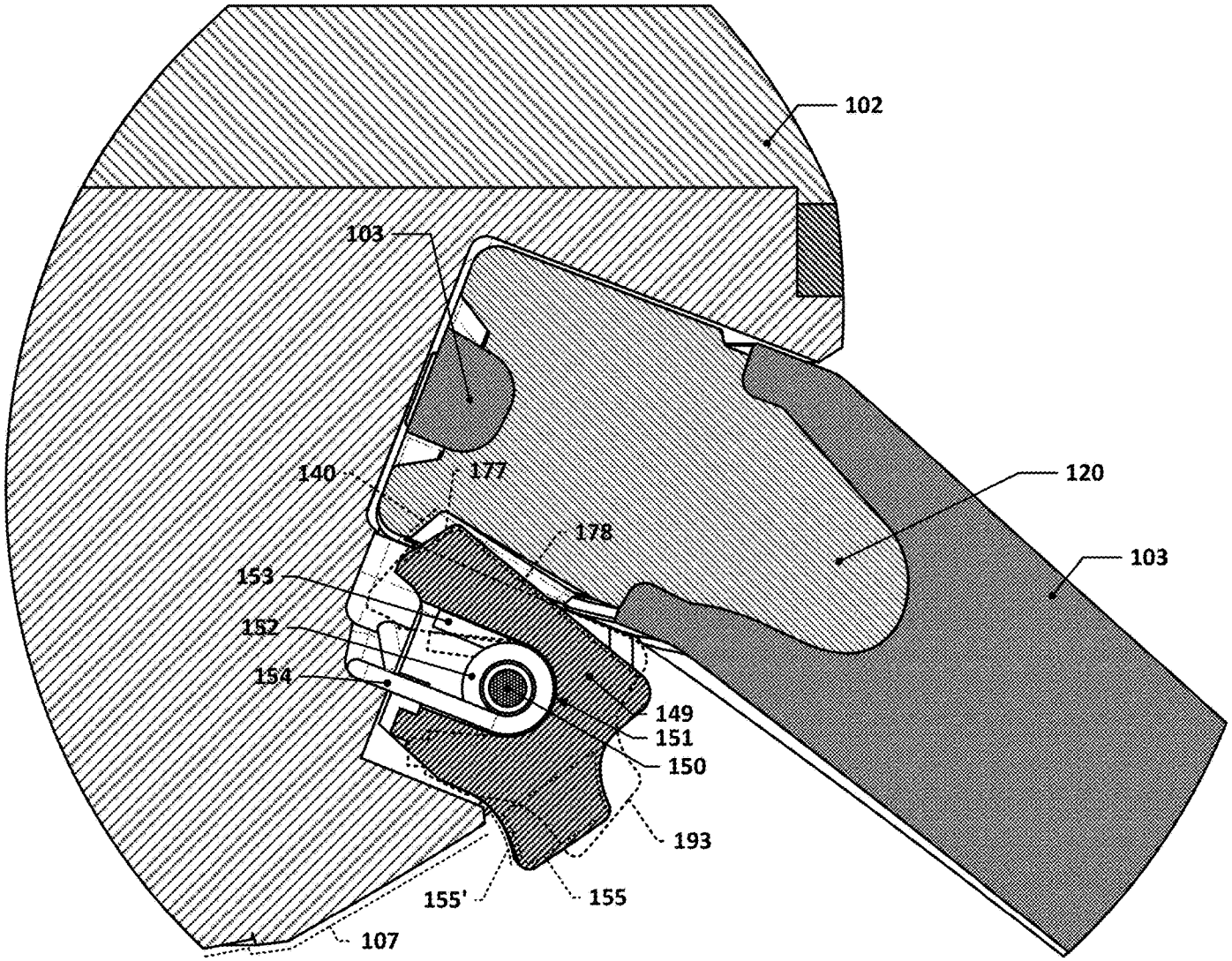
FIG. 22 is a side section view of the example device housing of FIG. 19 but with the elastomeric strap of FIG. 9 inserted into the example device housing.

FIG. 22 is a side section view of the example device housing of FIG. 19 but with the elastomeric strap of FIG. 9 inserted into the example device housing. As can be seen in FIG. 22, the rigid insert has a cross-section that just fits within the opening 172 when the release button 149 is rotated into the first position 193. Once the rigid insert 120 is fully inserted into the opening 172, the release button 149 may be allowed to rotate back to the second position, e.g., through the urging of the first spring 151, thereby bringing the engagement surface 177 into a position proximate to, and facing towards, the latching surface 140.

Figure 25:
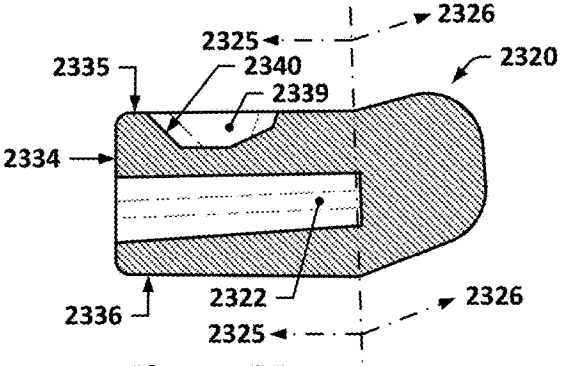
FIG. 25 is a side section view of the example rigid insert of FIG. 24.
Figure 23:
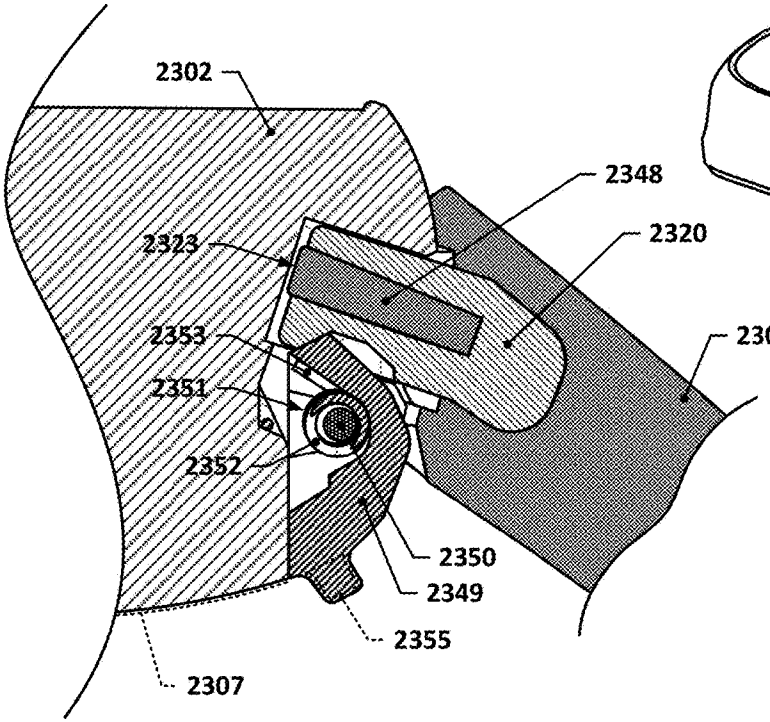
FIG. 23 is a side section view of another example device housing with another example elastomeric strap inserted therein.
Figure 24:
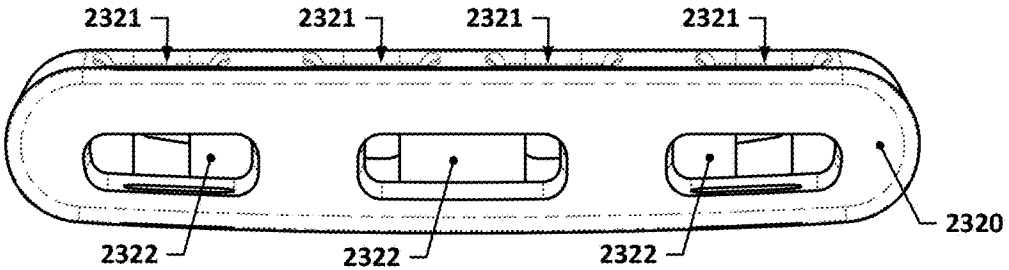
FIG. 24 is an end view of an example rigid insert of the example elastomeric strap of FIG. 23.

FIG. 23 is a side section view of another example device housing with another example elastomeric strap inserted therein. FIG. 24 is an end view of an example rigid insert of the example elastomeric strap of FIG. 23, and FIG. 25 is a side section view of the example rigid insert of FIG. 24. In FIG. 23, a device housing 2302 is shown that has a release button 2349 that is pivotably mounted to the device housing 2302 via one or more axles 2350. A first spring 2351 may be provided that acts to urge the release button 2349 to rotate clockwise (with regard to the orientation of FIG. 23) about the one or more axles 2350 so as to cause the release button 2349 to engage with a rigid insert 2320 of a strap 2303. The first spring 2351 may be a helical torsion spring that has a coil portion 2352 with a first leg 2353 that is pressed against a surface of the release button 2349 and a second leg (not shown) that is pressed against a surface of the device housing 2302.

The release button 2349 may be designed to be flush with a bottom surface 2307 of the device housing 2302, similar to the release button 149 and the bottom surface 107 of the device housing 102. The release button 2349 may also have a protrusion 2355 that may allow a user to cause the release button 2349 to rotate from the latched position to an unlatched position in which the rigid insert 2320 can be removed from the device housing 2302.

The rigid insert 2320, in this case, is similar to the rigid insert 120 in many ways, having first holes 2321 in a protrusion portion 2326 of the rigid insert 2320 that extend through the rigid insert 2320 in the direction of the thickness of the strap 2303. The strap 2303 may be co-molded with the rigid insert 2320, with portions of elastomeric material for the strap 2303 extending through the first holes 2321 in a direction generally aligned with the through-thickness direction of the strap. The rigid insert 2320, as with the rigid insert 120, has an insertion portion 2325 that is defined, at least in part, by the first surface 2334 and a second surface 2335 and a third surface 2336 that are both generally perpendicular to the first surface 2334. The second surface 2335 may include a recess 2339 that is partially defined by a latching surface 2340 that is at an oblique angle with respect to the first surface 2334.

As can be seen in FIG. 24, the rigid insert 2320 in this example has a cross-sectional shape in a plane parallel to the first surface 2334 that is generally obround in shape. In this example, the exterior surface of the insertion portion of the rigid insert 2320 is a hybrid obround, with the portion of the cross-sectional shape defined by the second surface 2335 being straight and the portion of the cross-sectional shape defined by the third surface 2336 being slightly convex.

While there are many similarities between the rigid insert 2320 and the rigid insert 120, there are also various differences in construction. As can be seen, the rigid insert 2320 does not include bumper ports as seen in the rigid insert 120 and also does not feature the second bridging portions 147 of the rigid insert 120. The rigid insert 2320 does, however, include second holes 2322 that extend all the way through the rigid insert 2320 to a first surface 2334 of the rigid insert 2320. While the strap 2303 does not have second bridging portions, the strap 2303 does have bumper posts 2348 (see FIG. 23) that extend through the second holes 2322 and protrude slightly through the first surface 2334 to act as bumpers ZB23 that may be used to absorb any axial compliance in the interface between the rigid insert 2320 and the device housing 2302.

Figure 26:
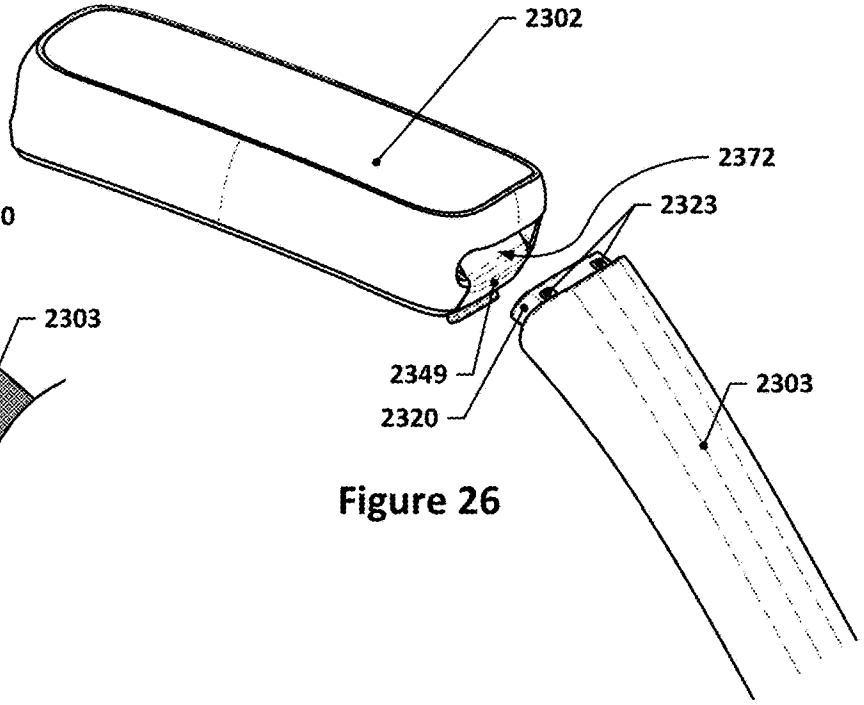
FIG. 26 depicts the device of FIG. 23 in a disconnected state.

Another difference between the rigid insert 2320 and the rigid insert 120 can be seen in FIG. 26, which depicts the strap 2303 and the housing 2302 of the device of FIG. 23 in a disconnected state. As can be seen in FIG. 26, the rigid insert 2320 has bumpers 2323 that are proud of the third surface #ZV36, as opposed to the second surface 2335 (the rigid insert 120, in contrast, has bumpers 123 proud of the second surface 135 instead of the third surface 136). The different locations of the bumpers 123 and 2323 may be selected, for example, depending on various factors. For example, top-mounted bumpers, such as the bumpers 2323, may be used in strap designs where through-thickness alignment (e.g., alignment along an axis that is generally perpendicular to the third surface 2336) between the strap and the device housing is not as critical. For example, in the strap 2303, the end of the strap butts up against the exterior of the housing 2302, and so some minor through-thickness misalignment between the strap 2303 and the device housing 2302 is simply not noticeable to the casual observer since the visible gap between the strap 2303 and the device housing 2302 is in a direction generally perpendicular to the through-thickness direction. In such designs, locating the bumpers 2323 along the third surface 2336 may cause the second surface 2335 to be pushed (through compression of the bumpers 2323) closer to the release button 2349 when the rigid insert 2320 is inserted into the opening 2372, thereby promoting even more secure latching between the latching receptacle and the rigid insert 2320. In straps such as the strap 103, however, minor through-thickness misalignment between the strap 103 and the device housing 102 may be more noticeable. Such straps may be referred as "garage-style" straps since the seating of the rigid insert 120 within the latching receptacle 118 is visible from the exterior, much as how the degree to which a car parked in a garage is aligned with the garage door frame is visible from the exterior of the garage (when the door is open, of course). In such straps, for example, the relatively small size of the rigid inserts and the latching receptacles may cause even small misalignments therebetween in the through-thickness direction to be considerably more noticeable than such misalignments would be in larger structures. In order to minimize such misalignments (and thus preserve the aesthetic appeal of the wearable device, which may be negatively impacted if the user perceives unsightly gaps between components), it may, as seen in the rigid insert 120, be preferable to use bottom-mounted bumpers, e.g., such as the bumpers 123 that are proud of the second surface 135. Such bumpers may act to push the rigid insert away from the release button somewhat so that the rigid insert is pressed into the top surface of the latching receptacle, thereby closing whatever gap exists between the top surface and the rigid insert. This results in a consistent and gap-free external appearance to the interface between the strap and the device housing when viewed by a user in a worn state.

While the above discussion has focused primarily on strap accessories that feature rigid inserts and elastomeric straps, other types of rigid inserts usable with other types of straps may be used with the latching receptacles discussed above. Several such alternative strap accessories are discussed below with respect to the following Figures.

Figure 27:
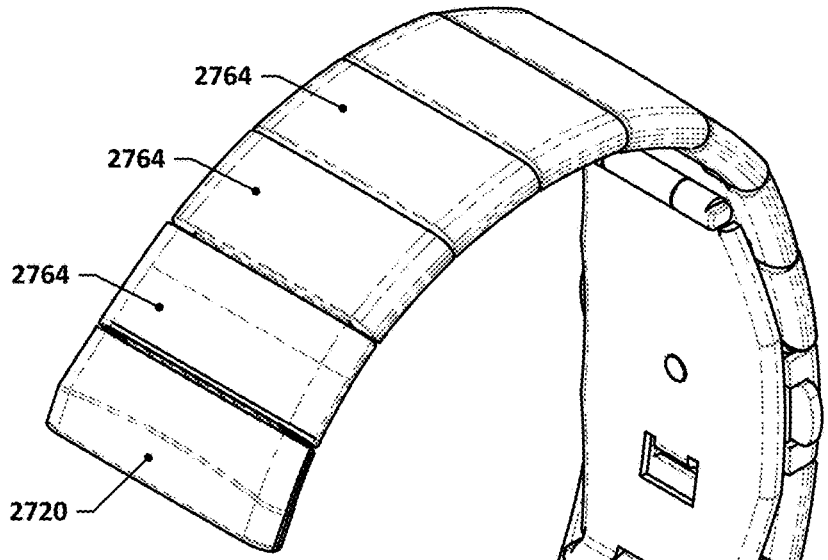
FIG. 27 is a perspective view of an example metal link bracelet.
Figure 28:
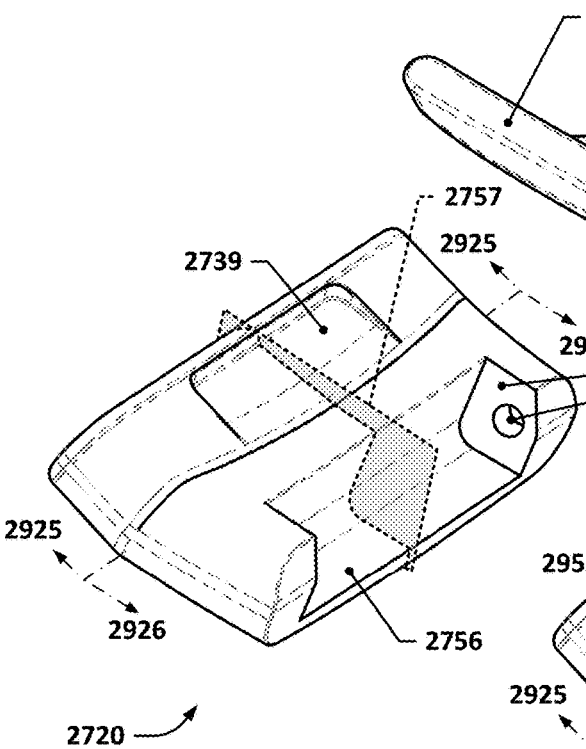
FIG. 28 is a perspective view of an example rigid insert for use with a metal link bracelet.

One such alternative strap accessory is a metal link bracelet, such as that shown in FIG. 27. As can be seen in FIG. 27, the metal link bracelet may include a chain of links 2764 that have, at each end, a rigid insert 2720. FIG. 28 is a perspective view of an example rigid insert for use with a metal link bracelet. As can be seen in FIG. 28, the rigid insert 2720 has an insertion portion 2725 that features a recess 2739 that is similar to the recess 139 in the rigid insert 120. The rigid insert 2720 also has a protrusion portion 2726 that includes a second recess 2756 that may, for example, receive a portion of one of the links 2764 (this portion may, for example, be similar in shape to the second portion 2960 that is discussed further below with respect to FIG. 29). A spring-loaded pin (not shown) may be inserted through the portion of such a link 2764 that is received in the second recess 2756 and inserted into holes 2763 that are on opposing end surfaces 2758, which may face toward each other and may be spaced apart from each other on either side of a midplane 2757 of the rigid insert 2720.

Figure 29:
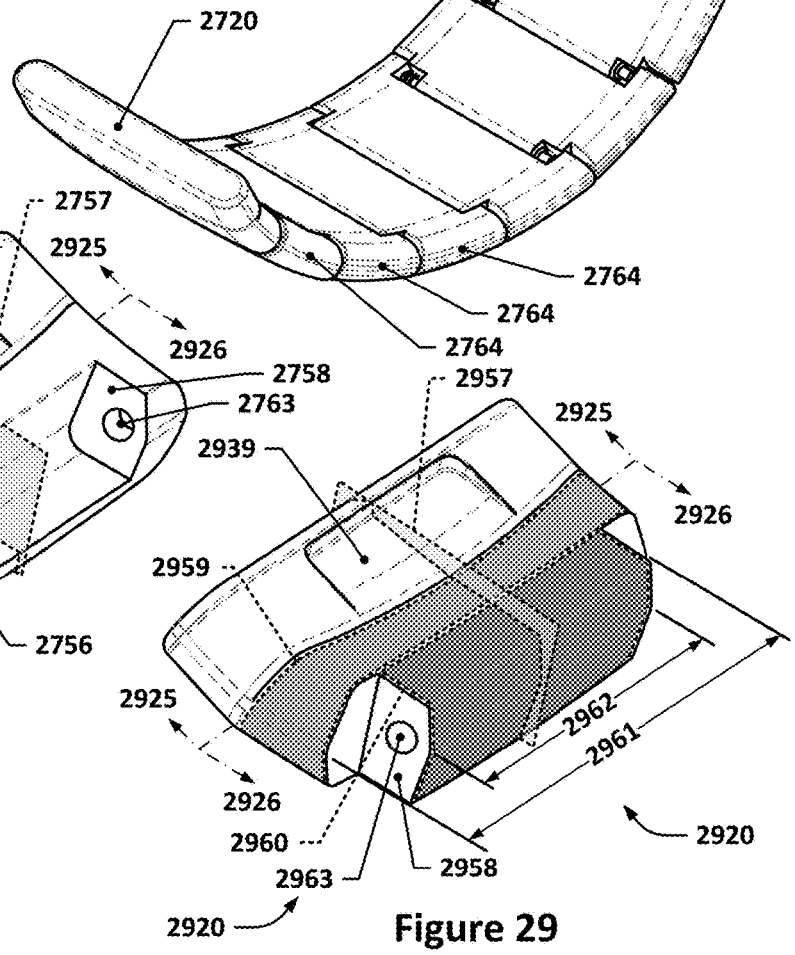
FIG. 29 is a perspective view of another example rigid insert for use with a metal link bracelet.

FIG. 29 is a perspective view of another example rigid insert for use with a metal link bracelet. The rigid insert 2920 of FIG. 29 is similar to the rigid insert 2720 and features in the rigid insert 2920 that correspond to features in the rigid insert 27 are indicated with callouts having the same two last digits. The discussion of such features with respect to FIG. 28 is to be understood to be equally applicable to those corresponding features in FIG. 29 unless indicated otherwise. The rigid insert 2920 has an insertion portion 2925 that is identical to that of the rigid insert 2720, but has a protrusion portion 2926 that is, in effect, the complement of that shown in FIG. 28. For example, instead of a recess 2739, the protrusion portion 2926 features a first portion 2959 having a first width 2961 and a second portion 2960 having a second width 2962. The first portion 2959 may be interposed between the insertion portion 2925 and the second portion 2960, and the second width 2962 may be less than the first width 2961. For example, the second width 2962 may be sized to be slightly less than the width of a receiving recess or slot in a corresponding link 2764 (similar to the second recess 2756 in FIG. 28).

The second portion 2960 may also have two end surfaces 2958 that face in opposite directions and are spaced apart from each other on either side of a midplane 2957, but unlike the end surfaces 2758, the end surfaces 2958 may face away from each other rather than towards each other. The second portion 2960 may also include a hole 2963 that extends between both end surfaces 2958 that may be used to house a pin that can be used to rotatably attach the rigid insert 2920 with a link 2764, for example.

In some implementations, such as that shown, the protrusion portion 2726 or 2926 may generally be a continuation of the cross section of the insertion portion 2725 or 2925, but along a different angle. For example, the insertion portion may generally be defined by a cross-section, e.g., a generally obround cross-section, that has the shape of an extrusion along a first axis (corresponding to the axis along which the insertion portion 2725 or 2925 is inserted into a device housing). The protrusion portion 2726 or 2926 may feature the same cross-section projected along another axis that makes, for example, an angle of between 10° and 20°, e.g., between 14° and 15°, with the first axis (the cross-section for the protrusion portion 2726 or 2926 may alternatively be the cross-section for insertion portion 2725 or 2925 projected on a plane that is coplanar with, or positioned within the angular range defined by, a first plane that is normal to the first axis and a second plane that is normal to the other axis. There may also be some tapering that occurs of this cross-section along one or both of the axes, and the axes may also have some minor curvature, e.g., on a level commensurate with the degree of arcing in the arcuate obround profiles discussed herein.

Figures 30, 31, 32:
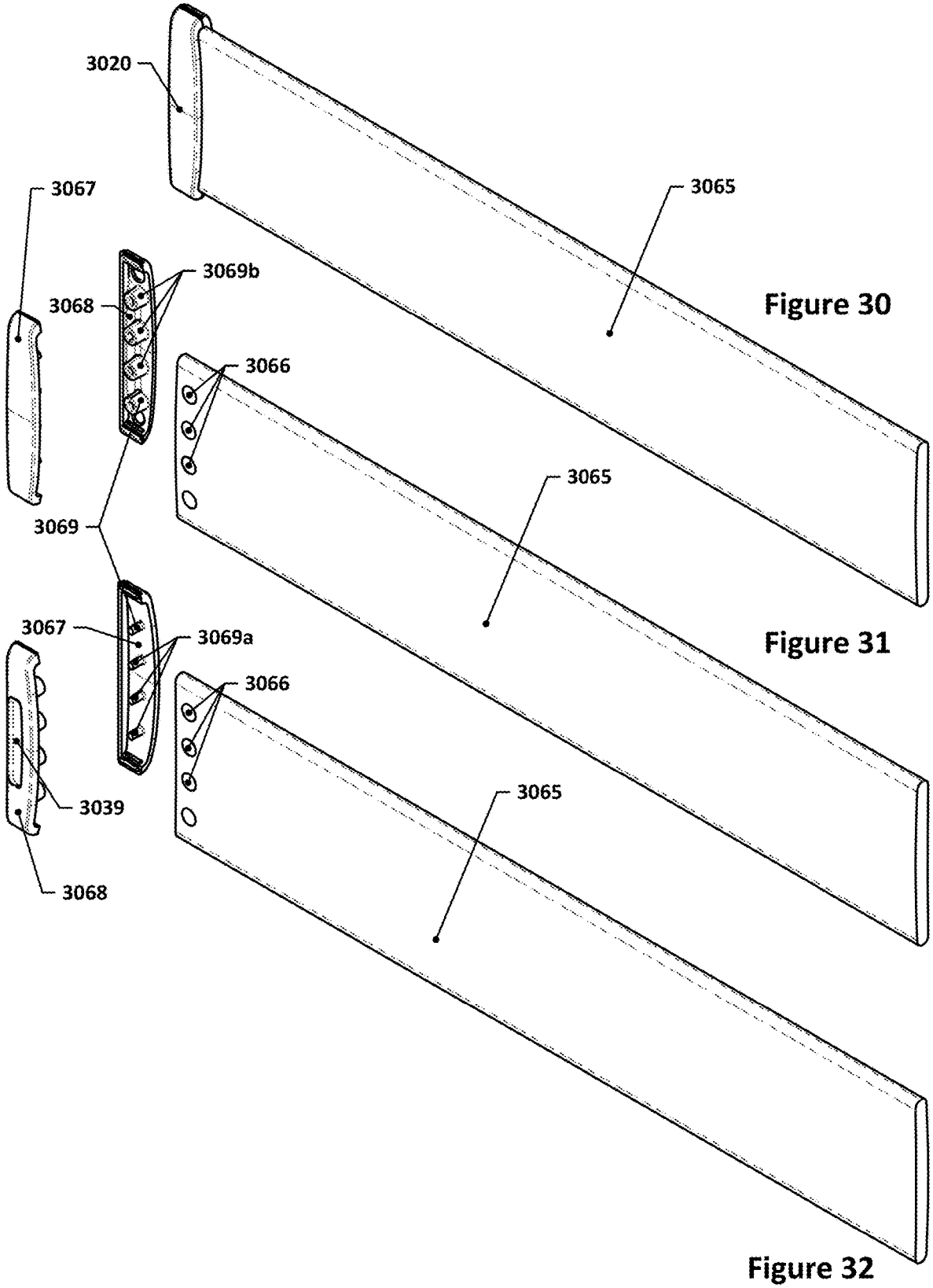
FIG. 30 is a perspective view of an example leather strap.
FIG. 31 is a perspective exploded view of the example leather strap of FIG. 30.
FIG. 32 is a reverse perspective exploded view of the example leather strap of FIG. 30.

Another example of a strap accessory that may utilize a form of rigid insert is a leather strap accessory (or a textile strap accessory—the rigid insert discussed below may be used with any suitable flexible woven, organic, or polymeric material). FIG. 30 is a perspective view of an example leather strap, with FIGS. 31 and 32 providing exploded views of the example leather strap of FIG. 30 from opposing perspectives.

As can be seen in FIGS. 30 through 32, a rigid insert 3020 is provided that is attached to a strap 3065, which may be of a flexible material, such as leather, woven textiles, or a flexible polymeric material. The rigid insert 3020, in this example, consists only of an insertion portion, with the material of the strap 3065 passing into the interior of the rigid insert 3020. The strap 3065 may have a series of retention holes 3066 that extend through the end of the strap 3065 that passes into the interior of the rigid insert 3020.

To facilitate such a connection, the rigid insert 3020 may be provided as a multi-piece assembly and may include, for example, a top cap 3067 and a bottom cap 3068. The top cap 3067 and the bottom cap 3068 may be connected with one another in some manner to form the rigid insert 3020. For example, the top cap 3067 and the bottom cap 3068 may be connected together by a series of post-and-hole features 3069, which may include, for example, one or more posts 3069*a* that are located on one or both of the top cap 3067 and the bottom cap 3068, and one or more holes 3069*b* that are located on the other of the top cap 3067 and the bottom cap 3068. The holes 3069*b* may, for example, be holes that are in bosses that protrude from an interior surface of the top cap 3067 and/or the bottom cap 3068 such that the bosses provide a larger-diameter surface with which to engage with the retention holes 3066 of the strap 3065, thereby decreasing the stress that is generated at the retention holes 3066 when the strap 3065 is under tension. The post-and-hole features 3069 may be designed such that the posts 3069*a* and the holes 3069*b* are sized to create an interference fit or, in some implementations, a transition or clearance fit where adhesives are used to permanently bond the posts 3069*a* into the holes 3069*b*.

As can be seen in FIG. 32, the bottom cap 3068 features a recess 3039 that is similar in size and shape to that of the rigid insert 120, allowing the strap accessory that is shown to be used in place of the elastomeric strap 103 with the device housing 102.

The latching mechanisms discussed above may be made with a relatively small number of parts, and may include, for example, single-spring and dual-spring designs. Both variants are discussed below in more detail.

Figure 33:
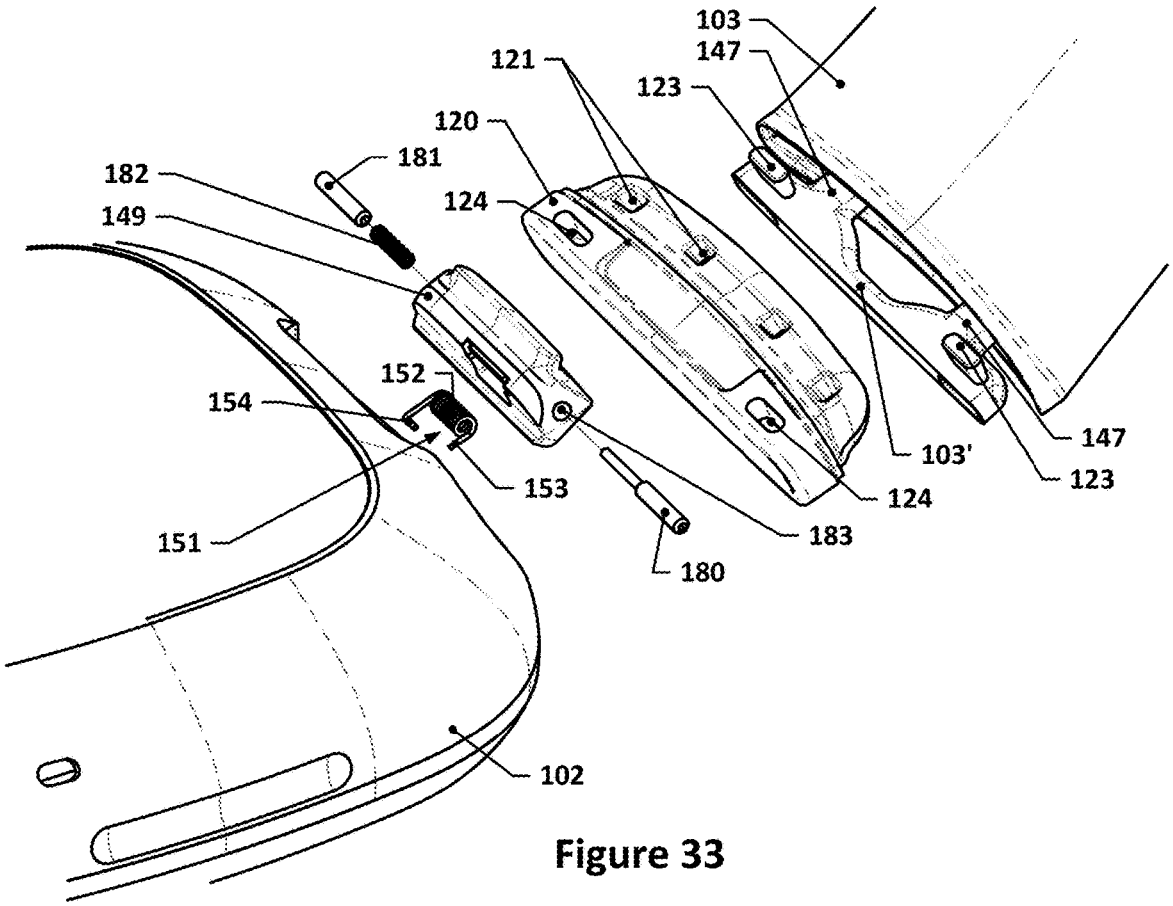
FIG. 33 is a perspective exploded view of an example latching mechanism.
Figure 34:
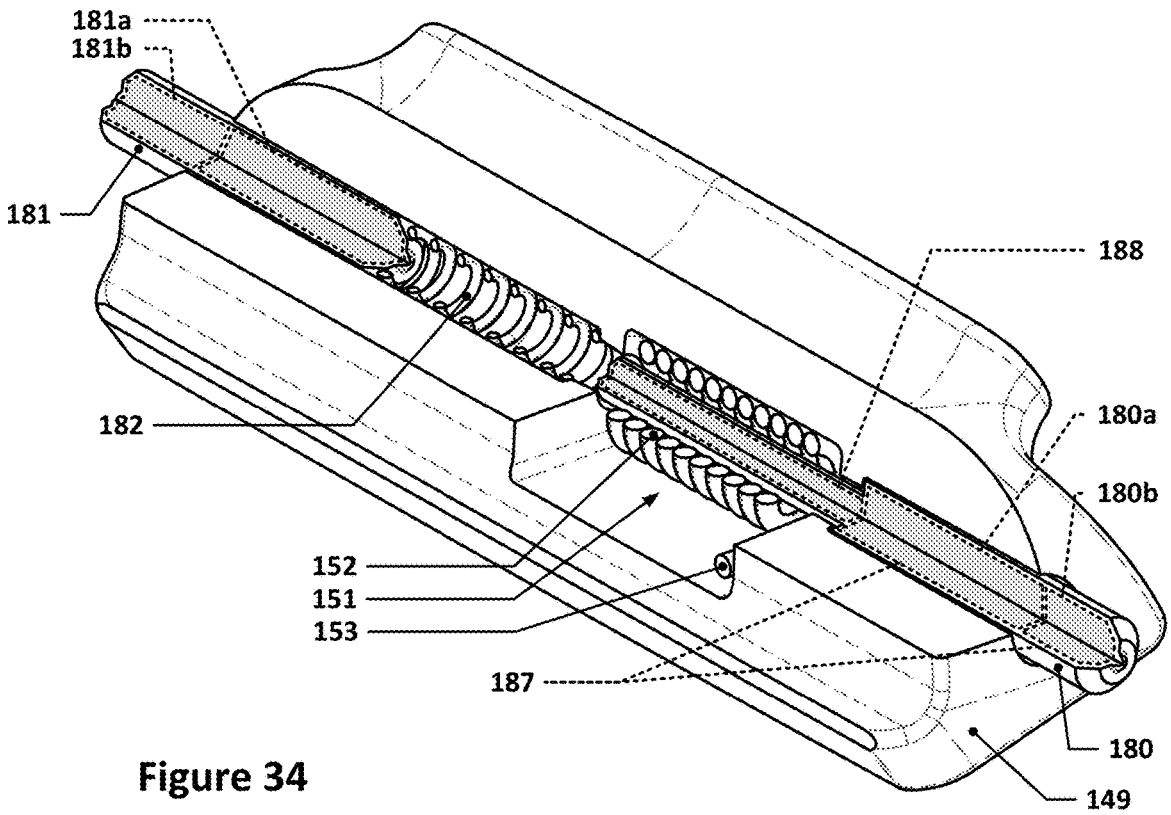
FIG. 34 is a perspective cutaway view of an example release button.

FIG. 33 is a perspective exploded view of an example latching mechanism; FIG. 34 is a perspective cutaway view of the example release button of FIG. 33. In FIG. 33, the latching mechanism with the release button 149 is shown, along with the device housing 102, the rigid insert 120, and the strap 103 (which is shown separated from the rigid insert 120, even though both components are co-molded together such that the material of the strap 103 cannot be separated from the rigid insert 120 without destroying the portion of the strap 103 that interfaces with the rigid insert 120).

While not intended to be the primary focus of FIG. 33, the second bridging portions 147 are both visible in FIG. 33, as well as the portion 103' of the strap 103 that spans between the ends of those second bridging portions 147 and serves to further secure the strap 103 to the rigid insert 120. Bumpers 123 are also visible, demonstrating how the bumpers 123 may be provided by extensions of the elastomeric material of the strap 103 through the bumper ports 124.

As can be seen in FIGS. 33 and 34, the release button 149 may be part of a latching mechanism that includes a first axle 180, a second axle 181, a first spring 151, and a second spring 182. In this example, the first spring 151 may be a helical torsion spring that is configured to rotationally urge the release button into the latched position, while the second spring 182 may be configured to urge the second axle 181 outward from the release button 149 along the pivot axis of the axles 180 and 181.

In some implementations, the first axle 180 may be configured to extend into the coil portion 152 of the first spring 151, thereby largely securing the first spring 151 in place relative to the release button 149. In the implementation shown, the first axle 180 has a first segment 187 and a second segment 188. The first segment 187 may have, for example, a first portion 180*a* that is positioned within a first hole 183 of the release button 149 and a second portion 180*b* that is positioned within a first pivot hole in the device housing 102 (not shown, but in a location that corresponds with the location of the one or more axles 150 shown in earlier Figures). As alluded to above, the first axle 180 may also have a second segment 188 that may be positioned within the release button 149 and which may extend through the coil portion 152 to pin the first spring 151 in place while still allowing the first spring 151 to torsionally flex. In some implementations, such as the one depicted, the second segment 188 may have a smaller diameter than the first segment 187, thereby allowing a smaller-size first spring 151 to be used while allowing the portion of the first axle 180 that protrudes into the pivot hole of the device housing 102 to be larger (and thus provide a more robust connection). The first leg 153 of the first spring 151 may be pressed against an exterior surface of the release button 149, e.g., the "floor" of the slot in the release button 149 within which the first spring 151 is housed.

In the implementation of FIGS. 33 and 34, the first axle 180 is generally unable to be positioned entirely within the release button 149 and the second portion 180*b* will always protrude from the release button 149. To allow the release button 149 to be installed in the recess in the device housing 102 that is provided to accommodate the latching mechanism 119, the second axle 181 may be configured to be able to slide axially so that the second axle 181 can be translated to a position that is entirely within, or nearly entirely within, the release button 149, thereby allowing the second portion 180*b* of the first axle 180 to be inserted into the corresponding first pivot hole at an angle. The release button 149 may then, with the second axle 181 pushed into the release button 149 to the maximum extent accommodated, be swiveled into the recess in the device housing that is provided to receive the latching mechanism 119. The second spring 182, which may be compressed by the translation of the second axle 181 towards the center of the release button 149, may then cause a second portion 181*b* of the second axle 181 to slide axially outward from the release button 149 and into a second pivot hole (also not shown) on the device housing 102 while a first portion 181*a* of the second axle 181 remains housed within a corresponding second hole of the release button 149, thereby securing the release button 149 to the device housing 102.

Another latching mechanism variant is shown in FIGS. 35 and 36. FIG. 35 is a perspective exploded view of another example latching mechanism, and FIG. 36 is another perspective exploded view of the example latching mechanism of FIG. 35. The latching mechanism shown is similar to that shown in FIGS. 23 through 25 and discussed previously. As is likely evident from the Figures, the device housing 2302 is smaller in width than the device housing 102, and the straps 2303 and the release button 2349 correspondingly smaller in size. As a result, the recess 2339 can be seen to extend across nearly the entire width of the second surface 2335, as compared with the recess 139 of the rigid insert 120, which only extends across about half the width of the second surface 135. Thus, the recesses 2339 and 139 may generally be the same size, even between release buttons of different widths.

However, as is evident from FIG. 34, the axle and spring arrangement of used in larger sized release buttons such as release button 149 may be too large to fit within a release button that is as small as the release button 2349. The arrangement shown in FIGS. 35 and 36 feature a more compact axle/spring arrangement that may be used with such smaller-sized release buttons (although such arrangements may also be used on larger sized release buttons as well).

In FIG. 35, the strap 2303 is shown in an exploded state, with the strap 2303 removed from the co-molded rigid insert 2320. The three bumper posts 2348 that extend through the second holes 2322 are visible, as are portions of the four first bridging portions 2346 that extend through the first holes 2321. As with the depiction of the strap 103 and the rigid insert 120 in FIG. 33, the strap 2303 and the rigid insert 2320 cannot, in actuality, be disassembled as shown without destroying the elastomeric material of the strap 2303 where it passes through the first holes 2321 and also, most likely, through the second holes 2322.

The latching mechanism in this example includes the release button 2349, the first spring 2351, a first axle 2380, and a second axle 2381. The first spring 2351 in this example, in contrast to the first spring 151, is an open-wound helical torsion spring. I an open-wound helical torsion spring, the coils are wound such that there is a gap between at least some adjacent coils along the winding axis. This, in effect, allows the coil portion to provide both torsional resistance and axial resistance along the winding axis, allowing the open-wound torsion spring to simultaneously act as a torsion spring and a compression spring. The first spring 151, by contrast, is shown as a close-wound helical torsion spring in which adjacent coils are either touching or nearly touching (with little practical ability to be compressed along the spring winding axis). The first spring 151, of course, could be replaced with an open-wound helical torsion spring.

As shown in FIG. 36, the first axle 2380 includes a first radial shoulder 2391 that butts up against one end of the first spring 151; the second axle 2381 correspondingly includes a second radial shoulder 2392 that butts up against the other end of the first spring 2351. When installed in the release button 2349, the first spring 2351 may be compressed axially between the first radial shoulder 2391 and the second radial shoulder 2392, thereby urging the first axle 2380 and the second axle 2381 away from each other along the centerlines of those axles.

The first axle 2380 and the second axle 2381 may each have a corresponding first portion 2380*a*/2381*a* that is positioned within a corresponding first hole 2383/2384 of the release button 2349, second portion 2380*b*/2381*b* that extends into a corresponding first pivot hole 2385/second pivot hole (not shown), and third portion 2380*c*/2381*c* that extends into the coil portion 2352 of the first spring 2351 on either end, thereby pinning the first spring 2351 in place relative to the release button 2349.

During installation of the release button 2349, one or both of the first axle 2380 and the second axle 2381 can be pressed into the release button 2349 to allow the release button 2349 to be inserted into the recess 2395 that is provided in the device housing 2302 to accommodate the release mechanism. The first axle 2380 and/or the second axle 2381 may then be allowed to be pushed outwards into the corresponding first pivot hole 2385 and/or second pivot hole 2386 by the first spring 2351.

It will be understood that the latching mechanisms discussed herein may be used for a wide variety of wearable devices and provide a low-profile mechanism that is easy to use, extremely strong, compact, and simple to manufacture.

Unlike other low-profile attachment mechanisms that utilize a C-shaped groove that extends along a side of the device housing and require that a cylindrical bead along the edge of the watch strap be inserted into the groove and then slid along the entire width of the device housing in order to engage the strap with the device housing, the mechanisms discussed herein allow for strap accessories to be attached to the device housing through the simple expedient of axially inserting the rigid inserts provided at the end of the straps into the device housing, i.e., the straps are inserted into, and removed from, the device housing along directions aligned with the long axis of the assembled limb-wearable device, as opposed to a direction transverse thereto. This allows the user to grasp the device housing in one hand while exerting a small amount of force on the release button with a digit of that hand and simply pull the strap accessory connected to the device housing via that release button with their other hand in order to remove the strap. Attachment of strap accessories may follow a reverse process, except that the user does not need to manipulate the release button at all due to the flank surface of the release button being pushed down naturally through the insertion of the rigid insert into the latching receptacle opening. In either case, the rigid insert need only travel on the order of 2 mm to 4 mm into the device housing in order to be securely latched, whereas C-shaped groove-based attachment mechanisms may require that the user force the strap accessory to slide in the groove for distances of 20 or 30 mm. For example, for the latching mechanism featuring the release button 149, the total amount of axial travel of the rigid insert 120 within the opening 172 that is needed to fully latch the rigid insert 120 with the latching mechanism 119 may be on the order of 3.2 mm to 4 mm. Similarly, for the latching mechanism featuring the release button 2349, the total amount of axial travel of the rigid insert 2320 within the opening that is needed to fully latch the rigid insert 2320 with the latching receptacle may be on the order of 2.2 mm to 2.6 mm. In fact, as discussed earlier, the latching mechanisms discussed herein are extremely compact overall, allowing for their integration into wearable devices while sacrificing very little in the way of device housing volume (which may otherwise be used for electronics, batteries, etc.). For example, the insertion portions 125 of the rigid inserts 120 discussed herein may, in some implementations, be approximately 20 mm to 25 mm, e.g., approximately 23.4 mm, in width, only about 3.3 mm thick, and only about 1.8 mm to 2.8 mm in length. The volume of the device housing that is used to provide the latching mechanisms for such rigid inserts, e.g., such as shown and discussed herein, may, of course, require a matching volume to receive the rigid insert 120 as well as additional volume to accommodate the release button 149 and associated hardware. However, due to the design of such latching mechanisms, the additional volume required may, in some cases, be less than the volume occupied by the rigid insert. For example, the latching receptacle 118 may occupy a volume that is the same width as the insertion portion of the rigid insert 120, e.g., about 23.4 mm, and may have a depth of that is generally matched to the length of the insertion portion 125 inserted therein. The height of the latching receptacle may be on the order of 5.5 mm to 6 mm in some implementations, e.g., 5.8 mm. The insertion portion 2325 of the rigid insert 2320 may, for example, be even smaller in size, e.g., approximately 2 mm in height and 13 mm in width, with a length of the insertion portion being approximately 2.4 mm to 3.4 mm. The latching receptacle for this smaller rigid insert may, in some implementations, be approximately the same width as the width of the insertion portion 2325 of the rigid insert 2320 and have a depth that is equivalent to the length of the insertion portion 2325. The height of the latching receptacle for the rigid insert 2320 may, for example, be approximately 4 mm, e.g., 4.2 mm, although the height may be somewhat undefined since the device housing 2302 does not "overhand" the release button 2349 in the same manner as the device housing 102 overhangs the release button 149. Regardless, the packaging envelope of the latching receptacle can be seen to be able to be fit within an envelope that is approximately twice as large as the envelope of the rigid insert while still being easily accessible to manipulation by a human finger and generally occupying a volume of less than 500 cubic millimeters.

Additionally, the strap attachment systems discussed herein do not require any components in the insertion portion of the rigid inserts of the strap accessories to be movable relative to any other part of the rigid inserts, which drastically simplifies assembly. In some cases, an entire strap component may be made without requiring any piece-part assembly. For example, an elastomeric adjustment strap may be made by simply co-molding the elastomeric material with a corresponding rigid insert, and the resulting co-molded component may be used without any further assembly being required.

The latching mechanisms discussed herein may be made from a variety of suitable materials. For example, the rigid inserts and release buttons discussed herein may be made from metals, such as aluminum alloys, titanium alloys, stainless steel alloys, etc., polymers, such as nylons, glass-filled nylons, polycarbonates, or other suitable materials. The axles may similarly be made from any of a variety of metal alloys and may, in some instances, even be polymeric, e.g., hard plastic, glass-filled nylon, etc. The springs discussed herein may be made from any suitable material, such as spring steel. Elastomeric straps, as discussed herein, may be made of any suitable elastomeric material, including, for example, silicones and thermoplastic elastomers.

Additionally, it will be recognized that the components discussed herein may be made with any suitable manufacturing technique. For example, the rigid inserts and release buttons may be made using injection molding techniques to produce net-shape parts with little or no post-molding machining being required. The device housing, for example, may be a single piece design that is machined out of a single piece of material, e.g., metal or polymer, that may be either a near-net-shape part produced by an injection molding process, for example, or a solid billet. In other implementations, the device housing may be assembled from multiple piece parts, each of which may be either a net-shape part produced through injection molding or a part machined from a near-net-shape part or a solid billet.

It is to be understood that the phrase "for each <item> of the one or more <items>," if used herein, should be understood to be inclusive of both a single-item group and multiple-item groups, i.e., the phrase "for . . . each" is used in the sense that it is used in programming languages to refer to each item of whatever population of items is referenced. For example, if the population of items referenced is a single item, then "each" would refer to only that single item (despite the fact that dictionary definitions of "each" frequently define the term to refer to "every one of two or more things") and would not imply that there must be at least two of those items.

Terms such as "about," "approximately," "substantially," "nominal," or the like, when used in reference to quantities or similar quantifiable properties, are to be understood to be inclusive of values within ±10% of the values or relationship specified (as well as inclusive of the actual values or relationship specified), unless otherwise indicated.

It is to be further understood that the above disclosure, while focusing on a particular example implementation or implementations, is not limited to only the discussed example, but may also apply to similar variants and mechanisms as well, and such similar variants and mechanisms are also considered to be within the scope of this disclosure.

What is claimed is:

1. An apparatus comprising:

a rigid insert, wherein:

the rigid insert includes an insertion portion that is configured to be insertable into a latching receptacle of a limb-wearable device;

the insertion portion of the rigid insert has an outermost cross-sectional boundary that is, when viewed along a first axis, inscribed within a boundary region defined between a first semicircle, a second semicircle, a first segment spanning between a first end of the first semicircle and a first end of the second semicircle, and a second segment spanning between a second end of the second semicircle and a second end of the first semicircle;

the insertion portion has a first surface that is perpendicular to the first axis and a second surface and a third surface that are both generally perpendicular to the first surface;

the insertion portion does not include any portion or component that is movable relative to the remainder of the insertion portion and configured to releasably engage with the latching receptacle of the limb-wearable device;

the first surface is interposed between the second surface and the third surface when viewed along the first axis;

a recess is located in the second surface and is defined, at least in part, by a latching surface that extends from the second surface towards the third surface and that is positioned such that it interfaces with a latch mechanism in the latching receptacle of the limb-wearable device when the rigid insert is fully inserted into the latching receptacle of the limb-wearable device;

the latching surface has a width along a direction nominally parallel to the second surface that is at least 8 mm; and the latching surface forms a first included angle with the first surface of between 20° and 50°.

2. The apparatus of claim 1, wherein at least one surface selected from the group consisting of: the second surface, the third surface, and both the second surface and the third surface is tapered by between 0.01° and 1° from the first axis.

3. The apparatus of claim 1, wherein at least one surface selected from the group consisting of: the second surface, the third surface, and both the second surface and the third surface is tapered by between 0.4° and 0.6° from the first axis.

4. The apparatus of claim 1, wherein the latching surface and the second surface virtually intersect at a location that is offset from the first surface in a direction normal to the first surface by a distance of between 0.35 mm and 0.6 mm.

5. The apparatus of claim 1, wherein:

the recess is further defined by a floor surface, and the floor surface spans between a first end proximate to the latching surface and a second end proximate to the second surface, and the floor surface forms a second included angle with the second surface that is between 7° and 10°.

6. The apparatus of claim 1, wherein the second surface is a concave surface and the third surface is a convex surface.

7. The apparatus of claim 6, wherein:

the insertion portion has an exterior surface with an arcuate obround profile, the second surface and the third surface are spaced apart by a gap, a first endcap surface spans between, and is tangent to, first ends of the second surface and the third surface, and a second endcap surface spans between, and is tangent to, second ends of the second surface and the third surface.

8. The apparatus of claim 1, wherein the latching surface and the second surface virtually intersect at a location that is offset from the first surface in a direction normal to the first surface by a distance of between 0.35 mm and 0.45 mm.

9. The apparatus of claim 1, wherein the second surface is a planar surface and the third surface is a convex surface.

10. The apparatus of claim 9, wherein:

the insertion portion has an exterior surface with a hybrid obround profile, the second surface and the third surface are spaced apart by a gap, a first endcap surface spans between, and is tangent to, first ends of the second surface and the third surface, and a second endcap surface spans between, and is tangent to, second ends of the second surface and the third surface.

11. The apparatus of claim 1, wherein:

the rigid insert further includes a plurality of first holes and a plurality of second holes, the first holes extend through the rigid insert along axes spanning between the second surface and the third surface, and the second holes extend through the rigid insert in first directions generally aligned with the first axis.

12. The apparatus of claim 11, further comprising:

a co-molded elastomeric strap, wherein the co-molded elastomeric strap includes first bridging portions that extend through the first holes, wherein each first bridging portion has a first end and a second end that are each connected with the first end or the second end of one or more of the other first bridging portions by a continuous portion of the co-molded elastomeric strap other than that first bridging portion.

13. The apparatus of claim 12, wherein the co-molded elastomeric strap includes second bridging portions that extend through the second holes, wherein each second bridging portion has a first end and a second end that are each connected with the first end or the second end of one or more of the other second bridging portions by a continuous portion of the co-molded elastomeric strap other than that second bridging portion.

14. The apparatus of claim 12, wherein the co-molded elastomeric strap includes bumper posts that extend through the second holes, wherein each bumper post has a first end that is connected with the first end of one or more of the other bumper posts by a continuous portion of the co-molded elastomeric strap and a second end that is proud of the first surface.

15. The apparatus of claim 12, wherein:

the co-molded elastomeric strap is configured to interface with a complementary adjustment strap, the co-molded elastomeric strap has a main portion, a first pass-through portion, a peg portion, and a second pass-through portion, the peg portion is interposed between the first pass-through portion and the second pass-through portion, the first pass-through portion is interposed between the peg portion and the main portion, and the first pass-through portion and the second pass-through portion each have a hole therethrough that is sized to allow the complementary adjustment strap to pass therethrough.

16. The apparatus of claim 15, wherein:

the main portion, the first pass-through portion, the second pass-through portion, and the peg portion are arranged along a strap axis, and each of the holes in the first pass-through portion and the second pass-through portion is an elongate hole with a long axis that is perpendicular to the strap axis and a length along the long axis that is greater than a width of at least a part of the main portion along an axis parallel to the long axis.

17. The apparatus of claim 12, wherein the co-molded elastomeric strap is made of one or more materials selected from the group consisting of: a hypoallergenic silicone, a silicone, and a thermoplastic elastomer.

18. The apparatus of claim 12, wherein:

the rigid insert includes two or more bumper ports in an exterior surface of the rigid insert, and the co-molded elastomeric strap includes two or more bumpers that each extend through a corresponding one of the bumper ports and are proud of the exterior surface.

19. The apparatus of claim 1, wherein:

the rigid insert includes a wall that extends away from the first surface and towards the latching surface, and the wall follows the outermost cross-sectional boundary.

20. The apparatus of claim 1, wherein:

the rigid insert includes a protrusion portion that extends away from the insertion portion in a direction oriented away from the first surface, the protrusion portion includes a second recess that extends from a midplane of the rigid insert to spaced-apart locations on either side of the midplane, the midplane is generally parallel to the first surface and the second surface and centered on the rigid insert, the second recess has end surfaces that face each other and are generally perpendicular to the first surface and the second surface, and each end surface has a hole therein.

21. The apparatus of claim 1, wherein:

the rigid insert includes a protrusion portion that extends away from the insertion portion in a direction oriented away from the first surface, the protrusion portion includes a second recess that extends from a midplane of the rigid insert to spaced-apart locations on either side of the midplane, the midplane is generally parallel to the first surface and the second surface and centered on the rigid insert, the protrusion portion includes a first portion that has a first width in a first direction parallel to the first surface and the second surface and a second portion that has a second width in the first direction, the first portion is between the second portion and the insertion portion, the first width is larger than the second width, the second portion has opposing end surfaces that are generally perpendicular to the first direction and that face in opposite directions, the recess has end surfaces that face each other, are generally perpendicular to the first surface and the second surface, and are spaced apart on either side of the midplane, and the second portion has a hole therethrough extending between the end surfaces.

22. The apparatus of claim 1, further comprising a strap having a first end with a plurality of retention holes therethrough, wherein:

the rigid insert is comprised of a top cap and a bottom cap, a series of post-and-hole features join the top cap to the bottom cap, each post-and-hole feature including a post protruding from one of the top cap and the bottom cap towards the other of the top cap and the bottom cap and a hole in the other of the top cap and the bottom cap that is sized to receive that post, the top cap and the bottom cap form an opening in an exterior surface of the rigid insert that is on an opposite side of the rigid insert from the first surface, and the first end of the strap is inserted through the opening and each post-and-hole feature of one or more of the post-and-hole features is inserted through a corresponding one of the retention holes.

* * * * *